US008201918B2

(12) United States Patent
Masuda et al.

(10) Patent No.: US 8,201,918 B2
(45) Date of Patent: Jun. 19, 2012

(54) INK INJECTING APPARATUS

(75) Inventors: Norihiro Masuda, Matsumoto (JP); Toshio Kumagai, Shiojiri (JP); Shinichi Kamoshida, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 495 days.

(21) Appl. No.: 12/358,880

(22) Filed: Jan. 23, 2009

(65) Prior Publication Data

US 2009/0184996 A1 Jul. 23, 2009

(30) Foreign Application Priority Data

Jan. 23, 2008 (JP) ..... 2008-012961
Dec. 3, 2008 (JP) ..... 2008-308988

(51) Int. Cl.
*B41J 2/165* (2006.01)

(52) U.S. Cl. ..... 347/32

(58) Field of Classification Search ..... 347/29–33
See application file for complete search history.

(56) References Cited

U.S. PATENT DOCUMENTS

| | | | | |
|---|---|---|---|---|
| 5,051,758 | A | 9/1991 | Markham | |
| 5,081,472 | A * | 1/1992 | Fisher | 347/33 |
| 5,774,162 | A * | 6/1998 | Fukuda | 347/175 |
| 6,361,141 | B1 * | 3/2002 | Baitz | 347/32 |
| 6,663,215 | B2 * | 12/2003 | Klausbruckner et al. | 347/22 |
| 7,083,252 | B2 | 8/2006 | Yokoyama et al. | |
| 7,267,422 | B2 * | 9/2007 | Brookmire et al. | 347/22 |
| 7,311,376 | B2 * | 12/2007 | Gast et al. | 347/33 |
| 7,393,095 | B2 * | 7/2008 | Oshima et al. | 347/102 |
| 7,731,329 | B2 * | 6/2010 | Yearout et al. | 347/36 |
| 7,828,407 | B2 * | 11/2010 | Gomez et al. | 347/22 |
| 2001/0002837 | A1 | 6/2001 | Takahashi et al. | |
| 2001/0045149 | A1 | 11/2001 | Granger | |
| 2004/0218003 | A1 * | 11/2004 | Monclus et al. | 347/35 |
| 2006/0017769 | A1 * | 1/2006 | Akiyama et al. | 347/28 |
| 2007/0040885 | A1 | 2/2007 | Kusunoki | |
| 2009/0180938 | A1 | 7/2009 | Noro et al. | |
| 2009/0213173 | A1 * | 8/2009 | Masuda et al. | 347/33 |
| 2009/0213174 | A1 | 8/2009 | Kamoshida et al. | |

FOREIGN PATENT DOCUMENTS

| | | |
|---|---|---|
| JP | 05-061389 | 3/1993 |
| JP | 06-191060 | 7/1994 |
| JP | 08-340080 A | 12/1996 |
| JP | 10-175292 | 6/1998 |
| JP | 2006-341392 | 12/2003 |
| JP | 2004-182875 | 7/2004 |

(Continued)

OTHER PUBLICATIONS

U.S. Appl. No. 12/393,365, filed Jun. 6, 2011, Office Action.

(Continued)

*Primary Examiner* — Charlie Peng
(74) *Attorney, Agent, or Firm* — Workman Nydegger

(57) ABSTRACT

An ink injecting apparatus includes a nozzle that is used for injecting ultraviolet-curable ink to a medium, an irradiation unit that includes an irradiation face for irradiating an ultraviolet ray to the ultraviolet-curable ink adhering to the medium, and a rotary body that has a holding area for holding the medium and a non-holding area on a circumferential face, rotates with the circumferential face facing the irradiation face, and includes a touch member that moves to a position for touching the irradiation face and is brought into touch with the irradiation face in the non-holding area in accordance with rotation of the rotary body for removing the ultraviolet-curable ink adhering to the irradiation face.

7 Claims, 11 Drawing Sheets

FOREIGN PATENT DOCUMENTS

| | | |
|---|---|---|
| JP | 2005-047261 | 2/2005 |
| JP | 2005-186422 | 7/2005 |
| JP | 2005-271582 | 10/2005 |
| JP | 2006-035826 | 2/2006 |
| JP | 2006-305773 | 11/2006 |
| JP | 2006-347024 | 12/2006 |
| JP | 2007-130784 | 5/2007 |

OTHER PUBLICATIONS

U.S. Appl. No. 12/393,632, filed Jul. 14, 2011, Office Action.
U.S. Appl. No. 12/393,685, filed Jun. 21, 2011, Office Action.
U.S. Appl. No. 12/393,632, filed Dec. 6, 2011, Office Action.
U.S. Appl. No. 12/393,685, filed Jan. 6, 2012, Final Office Action.

* cited by examiner

INK INJECTING APPARATUS

CROSS-REFERENCE TO RELATED APPLICATIONS

This application claims priority under the Paris Convention based on

Japanese Patent Application No. 2008-12961 (filed on Jan. 23, 2008) and

Japanese Patent Application No. 2008-308988 (filed on Dec. 3, 2008).

BACKGROUND

1. Technical Field

The present invention relates to an ink injecting apparatus, and more particularly, to an ink injecting apparatus that injects ultraviolet-curable ink to a medium.

2. Related Art

Ink injecting apparatuses that include a nozzle for injecting ink to a medium and a rotary body that has a holding area for holding the medium and a non-holding area on a circumferential face and rotates have been known (for example, see JP-A-10-175292. In addition, the ink injecting apparatuses having an irradiation unit, in which ultraviolet-curable ink (hereinafter, also referred to as UV ink) is injected from a nozzle to the medium, that includes an irradiation face for irradiating an ultraviolet ray to the UV ink adhering to the medium have been disclosed. In the above-described ink injecting apparatuses, the UV ink adhering to the medium is fixed to the medium by receiving the ultraviolet ray from the irradiation face of the irradiation unit.

However, in the above-described ink injecting apparatus, a part of the UV ink injected from the nozzle may not land in the medium and float inside the ink injecting apparatus. The UV ink that floats inside the ink injecting apparatus may adhere to the irradiation face of the irradiation unit. When the UV ink adheres to the irradiation face, irradiation of the ultraviolet ray by using the irradiation unit is not performed appropriately. As a result, the UV ink adhering to the medium may not be fixed to the medium appropriately. Accordingly, when the UV ink adheres to the irradiation face of the irradiation unit, the UV ink is needed to be removed appropriately from the irradiation face. Thus, a removal mechanism for removing the UV ink adhering to the irradiation face is disposed inside the ink injecting apparatus. However, in order to avoid a complicated configuration of the ink injecting apparatus, a removal mechanism having a simple configuration has been requested.

SUMMARY

An advantage of some aspects of the invention is that it provides an ink injecting apparatus capable of appropriately removing ultraviolet-curable ink adhering to the irradiation face of the irradiation unit under a simple configuration.

According to a main aspect of the invention, there is provided an ink injecting apparatus including: a nozzle that is used for injecting ultraviolet-curable ink to a medium; an irradiation unit that includes an irradiation face for irradiating an ultraviolet ray to the ultraviolet-curable ink adhering to the medium; and a rotary body that has a holding area for holding the medium and a non-holding area on a circumferential face, rotates with the circumferential face facing the irradiation face, and includes a touch member that moves to a position for touching the irradiation face and is brought into touch with the irradiation face in the non-holding area in accordance with rotation of the rotary body for removing the ultraviolet-curable ink adhering to the irradiation face.

The other aspects of the invention will become apparent from descriptions here and accompanying drawings.

BRIEF DESCRIPTION OF THE DRAWINGS

The invention will be described with reference to the accompanying drawings, wherein like numbers reference like elements.

DESCRIPTION OF EXEMPLARY EMBODIMENTS

Figure 1:
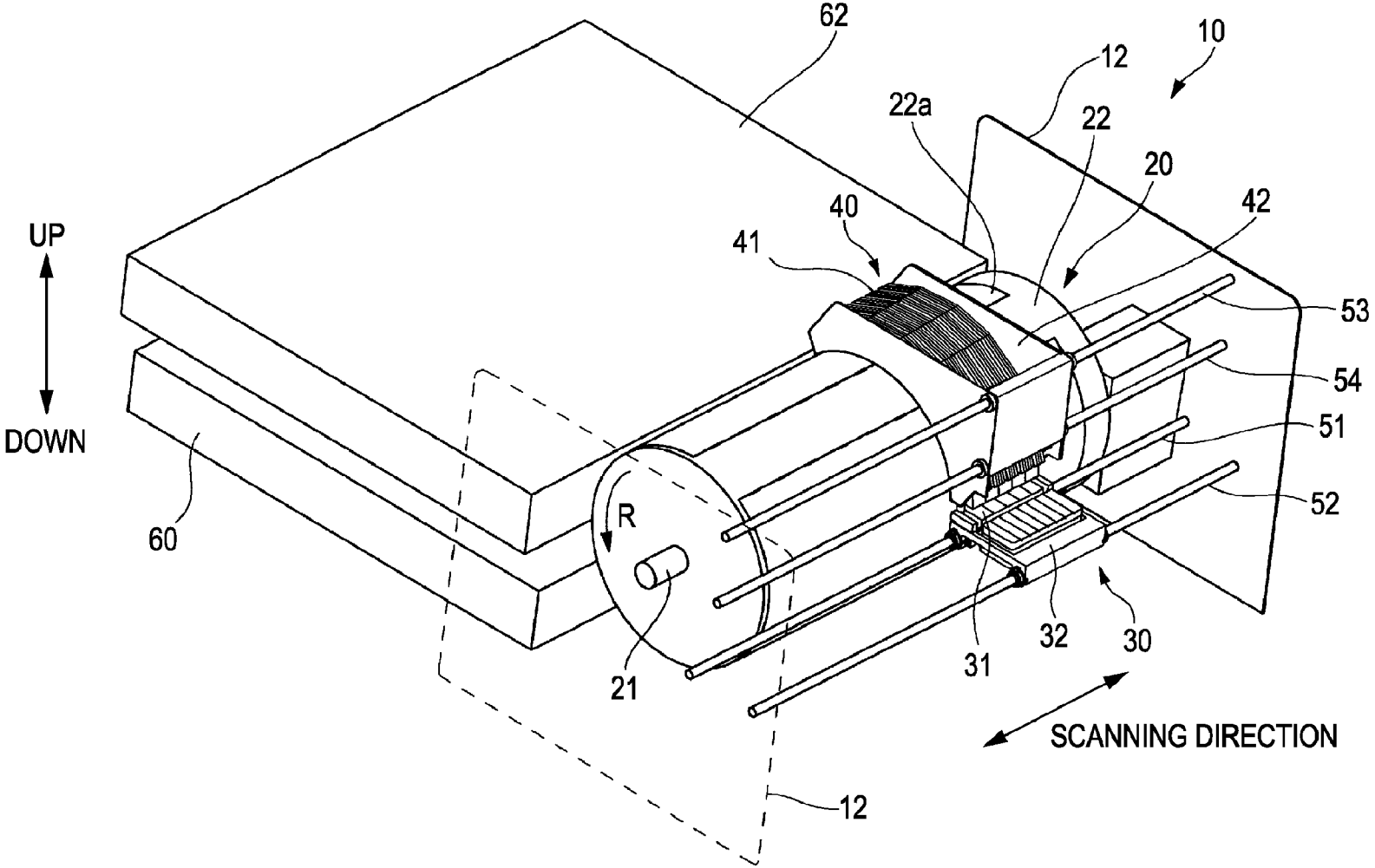
FIG. 1 is a schematic perspective view showing the structure of a printer 10 according to an embodiment of the invention.

At least the flowing aspects of the invention will be disclosed in descriptions below and the accompanying drawings.

According to a first aspect of the invention, there is provided an ink injecting apparatus including: a nozzle that is used for injecting ultraviolet-curable ink to a medium; an irradiation unit that includes an irradiation face for irradiating an ultraviolet ray to the ultraviolet-curable ink adhering to the medium; and a rotary body that has a holding area for holding the medium and a non-holding area on a circumferential face, rotates with the circumferential face facing the irradiation face, and includes a touch member that moves to a position for touching the irradiation face and is brought into touch with the irradiation face in the non-holding area in accordance with rotation of the rotary body for removing the ultraviolet-curable ink adhering to the irradiation face. In the above-described ink injecting apparatus, the ultraviolet-curable ink adhering to the irradiation face of the irradiation unit can be removed appropriately under a simple configuration.

The above-described ink injecting apparatus may further include a removal unit that is used for removing the ultraviolet-curable ink adhering to the touch member at a time when the ultraviolet-curable ink is removed by bringing the touch member into touch with the irradiation face. In such a case, adherence of the ultraviolet-curable ink that is removed by the touch member to the irradiation face again can be prevented.

In addition, in the above-described ink injecting apparatus, it may be configured that the touch member moves from the touching position to a position for contacting the removal unit and is brought into contact with the removal unit, in accordance with rotation of the rotary body after being brought into touch with the irradiation face in the touching position, and when the touch member is brought into contact with the removal unit, the removal unit cleans the touch member by using a cleaning solution. In such a case, the ultraviolet-curable ink adhering to the touch member is removed appropriately. When the touch member is to be brought into touch with the irradiation face again after being cleaned, the touch member is brought into touch with the irradiation face in a state in which the cleaning solution adheres. Accordingly, a friction force that is generated at a time when the touch member is brought into touch with the irradiation unit is decreased, and thereby the touch part is brought into touch with the irradiation unit appropriately.

In addition, the above-described ink injecting apparatus may further include a cleaning solution supplying unit that supplies a cleaning solution to the irradiation face for adhering the cleaning solution to the irradiation face, and it may be configured that the touch member moves to the position for touching the irradiation face and is brought into touch with the irradiation face in accordance with rotation of the rotary body after the cleaning solution supplying unit supplies the cleaning solution to the irradiation face. In the above-described ink injecting apparatus, the cleaning solution is penetrated into the ultraviolet-curable ink adhering to the irradiation face, and accordingly, the ultraviolet-curable ink can be removed by the touch member in an easy manner. In addition, the friction force that is generated at a time when the touch member is brought into touch with the irradiation unit is decreased, and accordingly, the touch part is brought into touch with the irradiation unit appropriately.

In addition, in the above-described ink injecting apparatus, the cleaning solution supplying unit may further include a second nozzle, disposed in the non-holding area, that moves to the position for facing the irradiation face and injects the cleaning solution to the irradiation face in accordance with rotation of the rotary body, and the touch member moves to the touching position and is brought into touch with the irradiation face in accordance with the rotation of the rotary body after the second nozzle moves to the facing position and injects the cleaning solution to the irradiation face in accordance with the rotation of the rotary body.

Alternatively, the cleaning solution supplying unit may further include a protrusion part, disposed in the non-holding area, that moves to the position for contacting the irradiation face and is brought into contact with the irradiation face in a front end portion containing the cleaning solution in accordance with the rotation of the rotary body, and it may be configured that the touch member moves to the touching position and is brought into touch with the irradiation face in accordance with rotation of the rotary body after the protrusion part moves to the position for contacting the irradiation face and is brought into contact with the irradiation face in the front end portion in accordance with rotation of the rotary body.

In such a case, the cleaning solution can be adhered to the irradiation face appropriately.

In addition, in the above-described ink injecting apparatus, the cleaning solution may be silicon oil. In such a case, when the ultraviolet-curable ink in the uncured state adheres to the irradiation face or the touch member, curing of the ultraviolet-curable ink can be suppressed. As a result, fixation of the ultraviolet-curable ink to the irradiation face or the touch member can be prevented.

In addition, in the above-described ink injecting apparatus, the cleaning solution may be silicon oil to which a polymerization inhibitor is added. In such a case, curing of the ultraviolet-curable ink adhering to the irradiation face or the touch member in the uncured state can be suppressed further.

In addition, the above-described ink injecting apparatus may further include a change mechanism that changes a protrusion amount of the touch member. In such a case, the rotary body is a rotary drum that rotates with the circumferential face facing a nozzle face in which the nozzle is formed and the irradiation face, the touch member protrudes to the outer side of the rotary drum in the diameter direction, and the change mechanism changes the protrusion amount such that the touch member is brought into touch with the irradiation face at a time when the touch member moves to the touching position in accordance with rotation of the rotary drum, and the touch member is not brought into touch with the nozzle face at a time when the touch member is located in the position for facing the nozzle face in accordance with rotation of the rotary drum. In such a case, an adverse affect on injection of ink from the nozzle due to bringing the touch member into touch with the nozzle face can be prevented.

Printer

Hereinafter, an ink jet printer (hereinafter, referred to as a printer 10) as an example of an ink injecting apparatus according to an embodiment of the invention will be described.

Example of Configuration of Printer

First, an example of the configuration of the printer 10 will be described with reference to FIGS. 1 and 2.

FIG. 1 is a schematic perspective view showing the structure of the printer 10. In FIG. 1, upper and lower directions of the printer 10 and the moving direction of a head 31 are denoted by arrows. FIG. 2 is a cross-section view showing the structure of a rotary drum 20 and peripheral devices. FIG. 2 shows a cross-section of which the normal line coincides with the shaft direction of a rotation shaft 21 of the rotary drum 20.

The printer 10 according to this embodiment is an apparatus that prints an image on a paper sheet based on print data by injecting UV ink on the paper sheet as an example of a medium in a case where the print data is received from a host computer that is not shown in the figure. The UV ink is ink that is prepared by adding an additive such as antifoam to a mixture of a vehicle, a photopolymerization initiator, and pigment.

The printer 10, as shown in FIG. 1, includes the rotary drum 20 as a rotary body, a head unit 30, and a UV irradiation unit 40 as an irradiation unit.

The rotary drum 20 is a rotary body that rotates about the rotation shaft 21 in a state in which a paper sheet is held on a circumferential face 22 thereof. The rotation shaft 21, as shown in FIG. 1, is supported by one pair of frames 12, which are erected to face each other, to be rotatable. Thus, when a driving force is transferred from a driving motor not shown in the figure, the rotation shaft 21 rotates. Accordingly, the rotary drum 20 rotates about the rotation shaft 21 at a constant angular velocity in the direction denoted by an arrow shown in FIG. 1.

Figure 2:
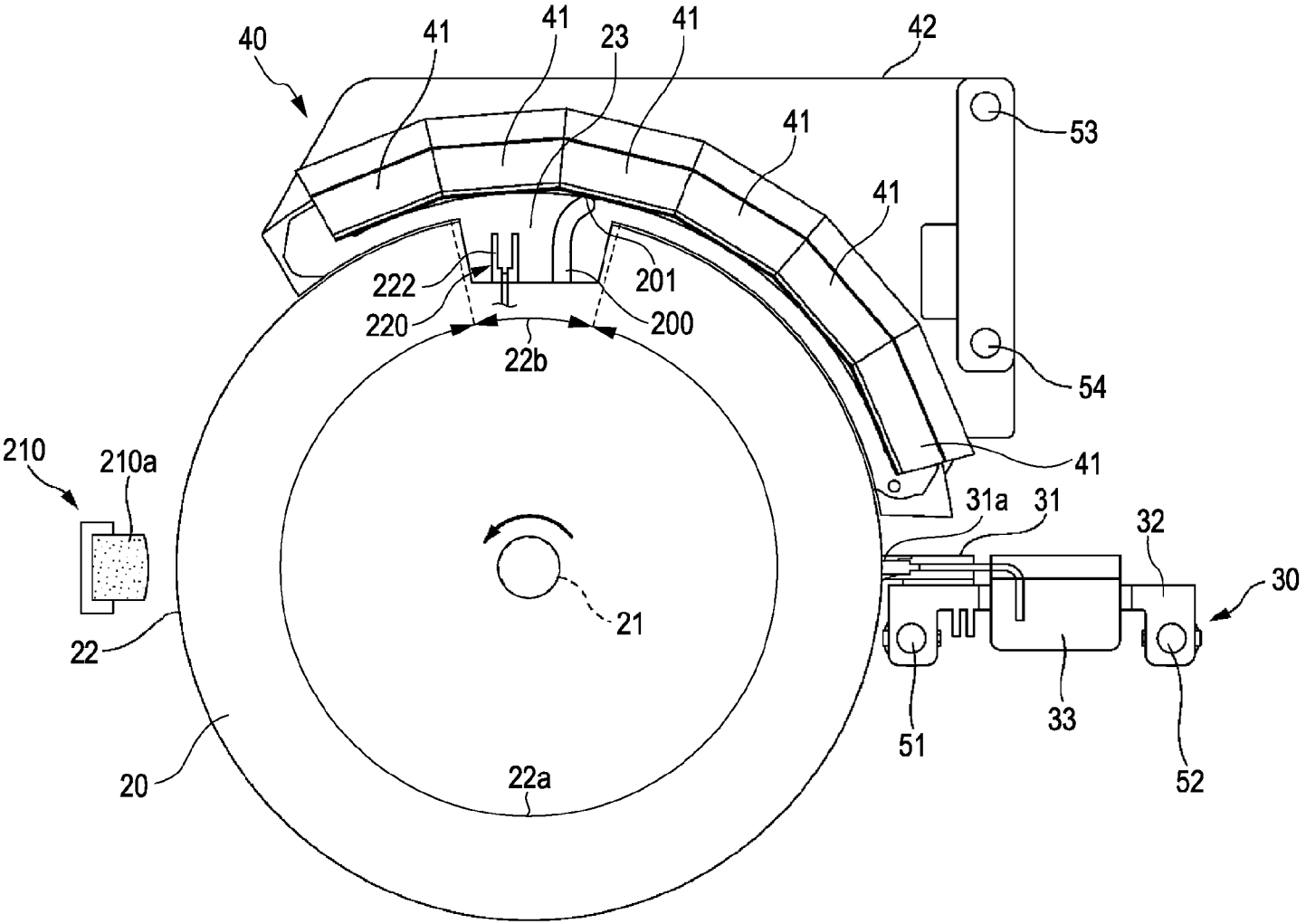
FIG. 2 is a cross-section view showing the structure of a rotary drum 20 and peripheral devices according to an embodiment of the invention.

According to this embodiment, as shown in FIG. 2, a holding area 22*a* in which a paper sheet is held and a non-holding area 22*b* in which any paper sheet is not held are included on a circumferential face 22 of the rotary drum 20. In addition, a part of the rotary drum 20 in which the non-holding area 22*b* is located is indented in the diameter direction of the rotary drum 20, and thereby an indentation 23 is formed. In other words, a part of the non-holding area 22*b* of the circumferential face 22 of the rotary drum 20 is positioned to the inner side of the rotary drum 20 relative to the holding area 22*a*.

In addition, inside the indentation 23, as shown in FIG. 2, a blade 200 as a touch member is disposed. Inside the rotary drum 20, a cleaning solution supplying unit 220 is disposed. In addition, a cleaning solution injecting nozzle 222 as a second nozzle that is included in the cleaning solution supplying unit 220 protrudes from the non-holding area 22*b* (more precisely, the bottom face of the indentation 23) toward the outer side of the rotary drum 20. The blade 200 and the cleaning solution supplying unit 220 will be described later.

The head unit 30 is used for injecting UV ink onto a paper sheet that is held on the circumferential face 22 (more precisely, the holding area 22*a*) of the rotary drum 20. This head unit 30, as shown in FIG. 2, includes a head 31 and a head carriage 32 in which the head 31 is loaded.

The head 31 has a nozzle face 31*a* on which a nozzle is formed so as to face the circumferential face 22 of the rotary drum 20. In other words, the rotary drum 20 rotates with the circumferential face 22 facing the nozzle (more particularly, the nozzle face 31*a*). The nozzle is used for injecting UV ink onto a paper sheet that is held on the circumferential face 22 of the rotary drum 20. The head carriage 32 is supported by guide shafts 51 and 52 that follow the rotation shaft 21 of the rotary drum 20 and reciprocates along the guide shafts 51 and 52. Accordingly, the head 31 can reciprocate along the shaft direction of the guide shafts 51 and 52 in accordance with movement of the head carriage 32. In addition, as shown in FIG. 2, to the head carriage 32, the ink cartridge 33 in which the UV ink is stored is detachably attached.

The UV irradiation unit 40 is used for irradiating the ultraviolet rays onto the UV ink that adheres to the paper sheet. This UV irradiation unit 40 is located on the downstream side of the head unit 30 in the rotation direction of the rotary drum 20. In addition, the UV irradiation unit 40 includes a plurality of lamp units 41 that is arranged along the rotation direction of the rotary drum 20 and an irradiation unit carriage 42 on which the plurality of lamp units 41 is mounted.

In each of the plurality of lamp units 41, an irradiation face that faces the circumferential face 22 of the rotary drum 20 is disposed. In other words, the rotary drum 20 rotates with the circumferential face 22 thereof facing the irradiation faces of the lamp units 41. Each of the plurality of lamp units 41 irradiates ultraviolet rays, which are emitted from a light source not shown in the figure, from the irradiation face toward the circumferential face 22. In other words, the irradiation face is included, so that the UV irradiation unit 40 can irradiate the ultraviolet rays. The irradiation unit carriage 42 is supported by guide shafts 53 and 54 that follow the rotation shaft 21 of the rotary drum 20 and moves along the guide shafts 53 and 54. Accordingly, the plurality of lamp units 41 moves along the shaft direction of the guide shafts 53 and 54 in accordance with movement of the irradiation unit carriage 42.

Nozzle

Figure 3:
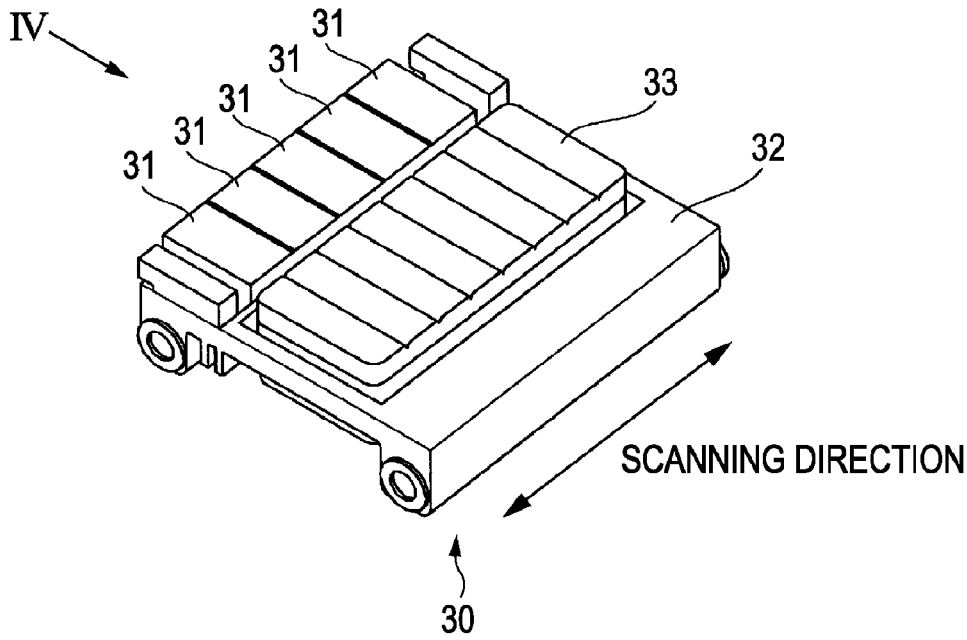
FIG. 3 is a perspective view of a head unit 30 according to an embodiment of the invention.
Figure 4:
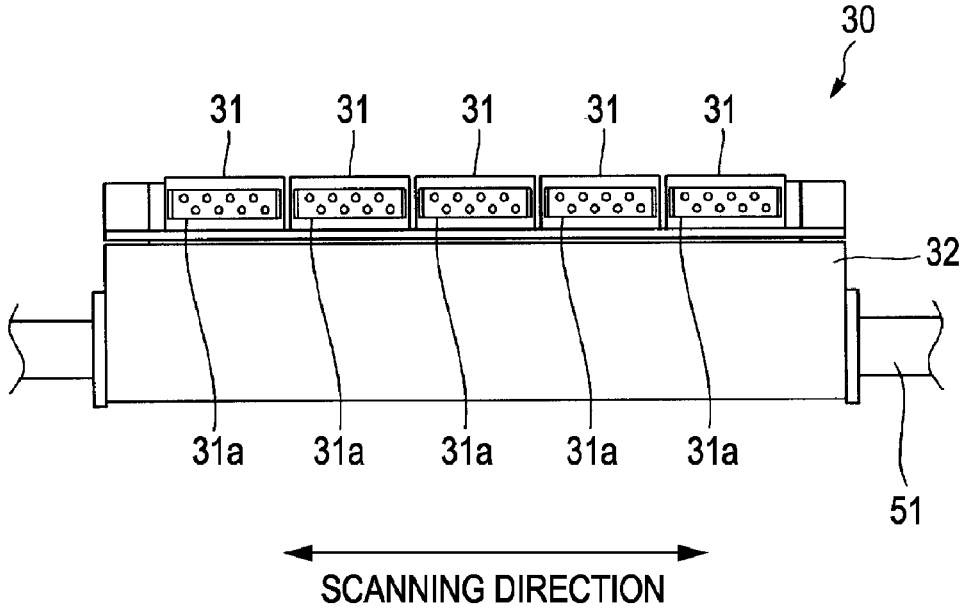
FIG. 4 is a diagram showing a nozzle face 31*a* according to an embodiment of the invention.

Next, the nozzle that is formed on the nozzle face 31*a* of the head 31 will be described with reference to FIGS. 3 and 4. FIG. 3 is a perspective view of the head unit 30. FIG. 4 is a diagram showing the nozzle face 31*a* and is a diagram of the head unit 30 viewed from a direction denoted by an arrow IV shown in FIG. 3. In FIGS. 3 and 4, the scanning direction of the head 31 is shown, respectively.

In the head unit 30 according to this embodiment, as shown in FIG. 3, a plurality of the heads 31 (five heads 31 in this embodiment) is aligned in the scanning direction. The heads 31 inject UV ink of different types. Described in detail, a head 31 that injects the UV ink of a black color, a head 31 that injects the UV ink of a cyan color, a head 31 that injects the UV ink of a magenta color, a head 31 that injects the UV ink of a yellow color, and a head 31 that injects the UV ink of a white color are disposed.

On the nozzle face 31*a* of the head 31, as shown in FIG. 4, a plurality of nozzles that are arranged at regular intervals in the scanning direction is formed. In each nozzle, an ink chamber, and a piezo element (both the ink chamber and the piezo element are not shown in the figure) are disposed. Accordingly, as the ink chamber expands or contracts by driving the piezo element, the UV ink is injected from the nozzle in a droplet form.

UV Irradiation Unit

Figure 5:
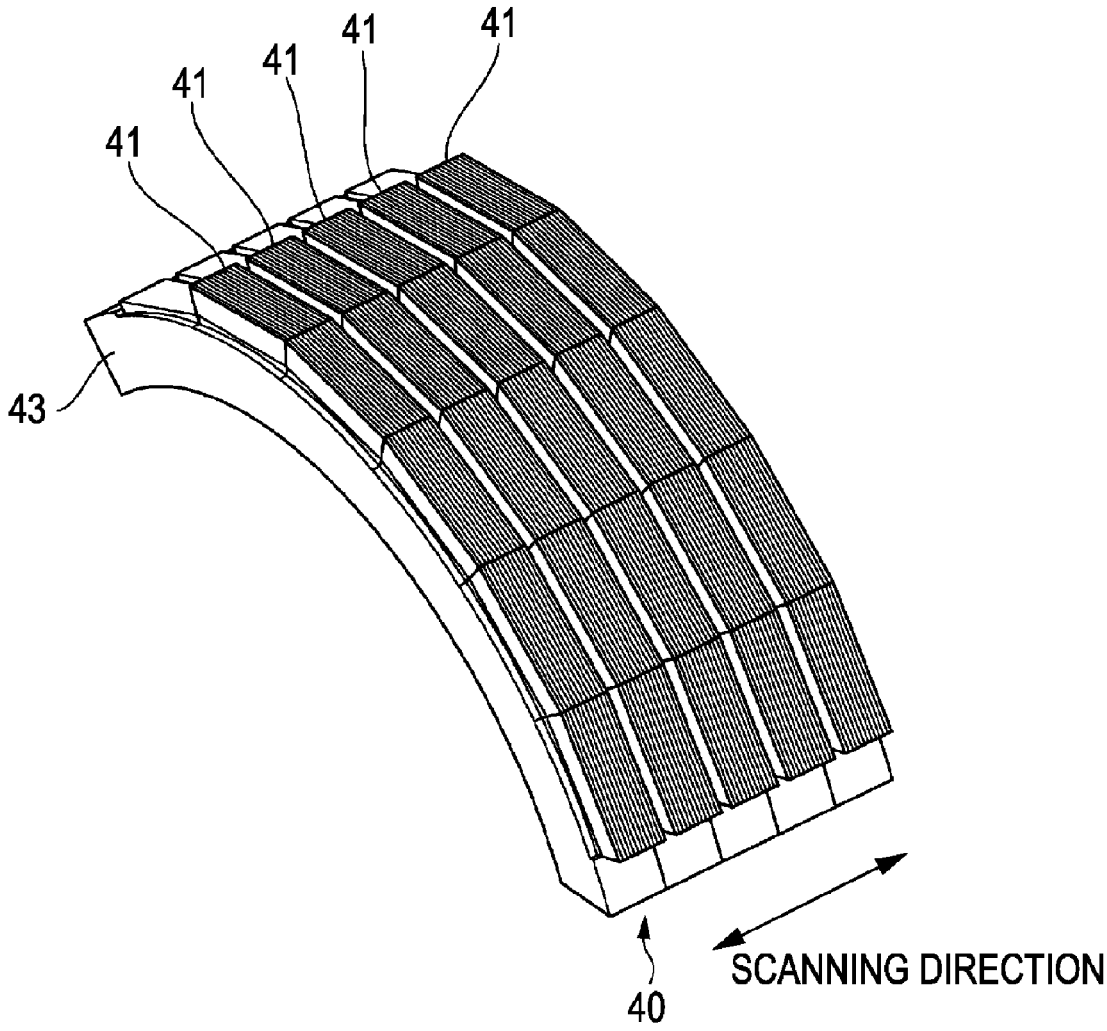
FIG. 5 is a perspective view of a UV irradiation unit 40 according to an embodiment of the invention.

Next, the UV irradiation unit 40 will be described with reference to FIG. 5. FIG. 5 is a perspective view of the UV irradiation unit 40. In FIG. 5, a direction (the scanning direction is shown alone in the FIG. 5) corresponding to the scanning direction of the head 31 is denoted by an arrow.

In the UV irradiation unit 40 according to this embodiment, a plurality of lamp units 41 (hereinafter, also referred to as a lamp unit row) that are arranged in the rotation direction of the rotary drum 20 is disposed in correspondence with corresponding the number of the heads 31. In other words, according to this embodiment, a lamp unit row for the UV ink of the black color, a lamp unit row for the UV ink of the cyan color, a lamp unit row for the UV ink of the magenta color, a lamp unit row for the UV ink of the yellow color, and a lamp unit row for the UV ink of the white color are disposed. The lamp unit rows, as shown in FIG. 5, are attached to a common holder 43 in a state in which the lamp unit rows are aligned in a direction corresponding to the scanning direction of the head 31. Accordingly, a plurality of irradiation faces corresponding to the types of ink is aligned in the scanning direction, and a plurality of the irradiation faces corresponding to the types of ink is also aligned in the rotation direction of the rotary drum 20.

As described above, since the lamp unit rows are disposed for each type of the UV ink, the wavelength and irradiation intensity of the ultraviolet ray that is irradiated from the lamp unit 41 can be set for each corresponding type of UV ink. As a light source included in the lamp unit 41, a metal halide lamp, a xenon lamp, a carbon arc lamp, a chemical lamp, a low-pressure mercury lamp, a high-pressure mercury lamp, or the like may be used.

In this embodiment, the width (the length of the head 31 in a direction corresponding to the scanning direction of the head 31) of each lamp unit 41 is configured to be longer than the width (the length in the scanning direction) of the nozzle face 31*a* of each head 31.

Configuration of Control Unit

Figure 6:
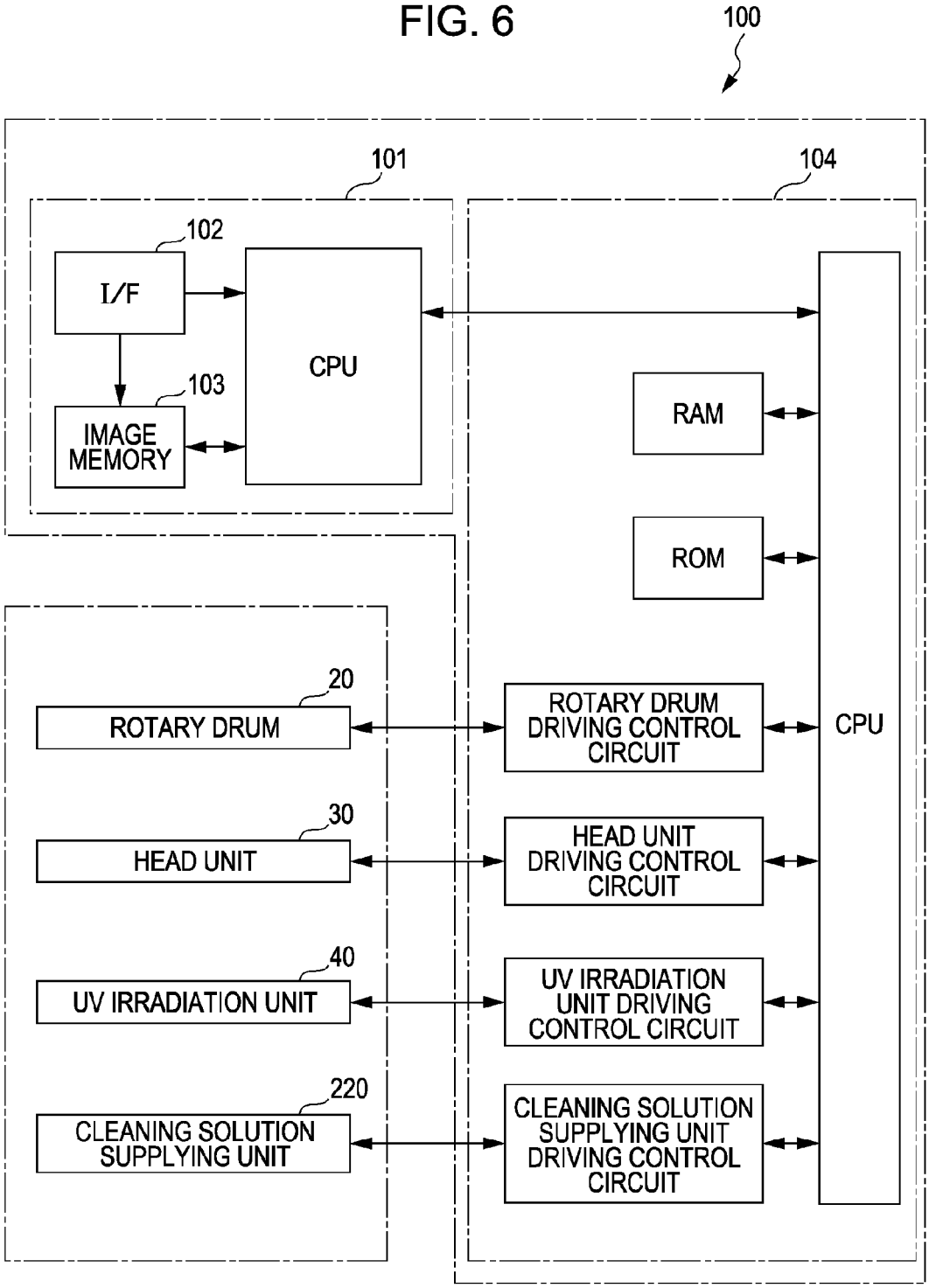
FIG. 6 is a block diagram showing a control unit 100 of the printer 10.

Next, the configuration of the control unit 100 will be described with reference to FIG. 6. FIG. 6 is a block diagram showing the control unit 100 of the printer 10.

A main controller 101 of the control unit 100, as shown in FIG. 6, includes an interface 102 (denoted by "I/F" in FIG. 6) that is used for connection to a host computer and an image memory 103 that is used for storing an image signal input from the host computer.

A sub controller 104, as shown in FIG. 6, is electrically connected to parts (the rotary drum 20, the head unit 30, the UV irradiation unit 40, and the like) of the main body of the printer. By receiving signals transmitted from sensors included in the units, the sub controller 104 controls the parts based on a signal input from the main controller 101 while detecting the state of each unit.

Operation of Printer

Next, an example of an operation (printing operation) for printing an image on a paper sheet by using the printer 10 that is configured as described above will be described.

First, when an image signal from the host computer is input to the main controller 101 of the printer 10 through the interface 102, the sub controller 104 controls the parts of the main body of the printer based on the direction from the main controller 101. Accordingly, the rotary drum 20 rotates, and the lamp unit 41 of the UV irradiation unit 40 irradiates an ultraviolet ray.

Meanwhile, the paper sheet supplied from the paper feed unit 60 is transported up to the rotary drum 20, and the face side of the paper sheet can be wound around the rotary drum 20 along the rotation shaft 21 of the rotary drum 20. Then, the paper sheet is held in the holding area 22*a* by a holding mechanism (not shown) that is installed in the holding area 22*a* of the circumferential face 22 of the rotary drum 20.

When the paper sheet rotates together with the rotary drum 20 in a state in which the paper sheet is held on the circumferential face 22 of the rotary drum 20, UV ink is injected from the nozzle of each head 31. Then, the UV ink lands in a part of the paper sheet that reaches a position facing the nozzle face 31*a* of the head 31. At this moment, since the paper sheet rotates, the part of the paper sheet that reaches the position facing the nozzle face 31*a* of the head 31 changes in a direction intersecting the direction of the face of the paper sheet. As a result, a dot line is formed on the paper sheet along the direction intersecting the face of the paper sheet.

When the part of the paper sheet, to which the UV ink adheres, moves to a position facing the irradiation face of the lamp unit 41 in accordance with rotation of the paper sheet, the lamp unit 41 irradiates an ultraviolet ray to the UV ink. Accordingly, when the UV ink injected from the nozzle adheres to the paper sheet, the ultraviolet ray is irradiated to the UV ink instantly. Therefore, the UV ink adhering to the paper sheet is cured, and thereby, the dot line that is formed on the paper sheet is fixed to the paper sheet.

In addition, since the lamp units 41 are disposed for each type of the UV ink, the UV ink adhering to the paper sheet receives the ultraviolet ray from the lamp unit 41 corresponding to the type.

In addition, according to this embodiment, since the plurality of lamp units 41 is disposed in accordance with the rotation direction of the rotary drum 20, the ultraviolet ray can be irradiated sufficiently for the UV ink adhering to the paper sheet.

When the paper sheet rotates further such that the part of the paper sheet, to which the UV ink has adhered already, reaches the position facing the nozzle again, each head 31 moves in the scanning direction. Thereafter, an operation that is the same as above is performed. As a result, to the UV ink cured so as to adhere to the paper sheet, the UV ink of a color different from that of the cured UV ink can adhere repeatedly. Accordingly, it can be prevented that UV ink of a different color is mixed with uncured UV ink.

In addition, each lamp unit 41 moves in the scanning direction in accordance with movement of each head 31 in the scanning direction. Accordingly, even after each head 31 moves, each lamp unit 41 irradiates the ultraviolet ray to the UV ink of a type corresponding to the lamp unit 41. In addition, the width of the irradiation face of each lamp unit 41 is configured longer than the width of the nozzle face 31*a* of each head 31. Thus, even when timings for moving the head 31 and for moving the lamp unit 41 are deviated from each other more or less, the ultraviolet ray can be sufficiently irradiated to the UV ink adhering to the paper sheet.

As the above-described operation is repeatedly performed, dot lines of each color that extend for the entire image printing area of the paper sheet are fixed. Accordingly, the image is printed on the paper sheet finally. Then, the paper sheet on which the image is printed is detached from the rotary drum 20 and is transported to the discharge unit 62.

Removing UV Ink Adhering to Irradiation Face

A part of the UV ink that is injected from the nozzle of each head 31 may not land in the paper sheet located on the rotary drum 20 but adhere to the irradiation face (more precisely, the irradiation face of each lamp unit 41) of the UV irradiation unit 40. In such a case, the ultraviolet ray is not appropriately irradiated by the UV irradiation unit 40.

Described in more details, as described in "Related Art", a part of the UV ink that is injected from the nozzle may float inside the printer 10 so as to adhere to the irradiation face. When the UV ink adhering to the irradiation face is neglected, the UV ink is deposited on the irradiation face. Accordingly, a ratio (hereinafter, also referred to as an ultraviolet irradiation efficiency) of the ultraviolet ray that is received by the UV ink landing in the paper sheet to the ultraviolet ray irradiated by the UV irradiation unit 40 is decreased. In addition, from a part of the irradiation face in which the UV ink is deposited, an ultraviolet ray is not irradiated appropriately. Thus, when a part of the irradiation face in which the paper sheet is held faces the part of the irradiation face in which the UV ink is deposited, an ultraviolet ray is not irradiated appropriately to the UV ink that lands in the part in which the paper sheet is held. As a result, uneven fixing of the UV ink is generated in the paper sheet, and the quality of the image formed on the paper sheet may deteriorate.

On the other hand, according to this embodiment, as a mechanism for removing the UV ink that adheres to the irradiation face, the blade 200 is disposed in the non-holding area 22*b* of the rotary drum 20. Hereinafter, first, the blade 200 will be described with reference to FIG. 2 described above.

The blade 200 is used for scraping and removing the UV ink adhering to a touching face by being brought into touch with the irradiation face of the UV irradiation unit 40. The blade 200 according to this embodiment is a member in an approximate rectangular parallelepiped shape that is formed of an elastic material such as rubber or fluorine resin. The blade 200 is disposed in the non-holding area 22*b* so as to protrude to the outer side of the rotary drum 20 from the non-holding area 22*b* of the circumferential face 22 of the rotary drum 20. Described in more details, the blade 200 is housed in the above-described indentation 23 in a state in which the longitudinal direction of the blade 200 follows the shaft direction (that is, the scanning direction of the head 31) of the rotation shaft 21 of the rotary drum 20. According to this embodiment, the length of the blade 200 in the longitudinal direction is configured longer than that of the moving range of the UV irradiation unit 40 in the scanning direction.

When the rotary drum 20 rotates, the blade 200 rotates integrally with the rotary drum 20. Accordingly, the blade 200 moves relatively with respect to the irradiation face in the rotation direction of the rotary drum 20 in accordance with the rotation of the rotary drum 20. The protrusion amount of the blade 200 is configured slightly longer than a distance between a face (that is, the bottom face of the indentation 23) located on the innermost side of the non-holding area 22*b* in the diameter direction of the rotary drum 20 to the irradiation face in a case where the non-holding area 22*b* faces the irradiation face. Accordingly, the blade 200 moves to a touching position for touching the irradiation face of the UV irradiation unit 40 in accordance with the rotation of the rotary drum 20. In the touching position, the blade 200 is brought into touch with the irradiation face on the touching face 201 that is formed in a front end portion thereof.

Here, the touching position for touching the irradiation face indicates a position of the blade 200 in the rotation direction of the rotary drum 20 during the blade 200 is brought into touch with the irradiation face. The irradiation face has a constant width in the rotation direction. Accordingly, after the blade 200 starts to be brought into touch with the irradiation face until bringing the blade 200 to be into touch with the irradiation face is completed, the touching position changes in the rotation direction. As described above, since the plurality of the irradiation faces is disposed in the UV irradiation unit 40 in a state in which the irradiation faces are arranged in the rotation direction, the touching position changes in the range from a position of the blade 200 for a case where the blade starts to be brought into touch with the irradiation face on the uppermost stream side in the rotation direction to a position of the blade 200 for a case where the touch of the blade 200 for the irradiation face on the downmost stream side is completed.

In addition, according to this embodiment, since the length of the blade 200 in the longitudinal direction is configured longer than that of the moving range of the UV irradiating unit 40 in the scanning direction, the blade 200 can be brought into touch with the plurality of the irradiation faces (irradiation faces corresponding to types of ink), which are aligned in the scanning direction, in the touching position. In addition, since the UV irradiating unit 40 moves in the scanning direction in accordance with movement of the irradiation unit carriage 42, the part of the blade 200 that is brought into touch with the irradiation face changes in the longitudinal direction of the blade 200 in accordance with the movement of the UV irradiating unit 40.

As described above, the blade 200 moves in the rotation direction of the rotary drum 200 in a state in which the touching face 201 is brought into touch with the irradiation face. As a result, the blade 200 scrapes out and removes the UV ink adhering to the irradiation face.

In addition, according to this embodiment, a cleaning solution supplying unit 220 and a blade cleaning unit 210 as a removal unit are disposed for appropriately removing the UV ink adhering to the irradiation face by using the blade 200. Subsequently, the cleaning solution supplying unit 220 and the blade cleaning unit 210 will now be described with reference to FIG. 2.

The cleaning solution supplying unit 220 supplies silicon oil as a cleaning solution to the irradiation face before the blade 200 is brought into touch with the irradiation face. By having the silicon oil that is supplied by the cleaning solution supplying unit 220 adheres to the irradiation face, the UV ink can be removed from the irradiation face easily in a case where the blade 200 is brought into touch with the irradiation face. Described in more details, when the silicon oil adhering to the irradiation face penetrates into the UV ink adhering to the irradiation face in a cured state, the UV ink is slightly softened. Accordingly, the UV ink can be scraped out and removed by the blade 200 in an easy manner.

In addition, by having the silicon oil adhere to the irradiation face, for example, in a case where the UV ink in an uncured state adheres to the irradiation face, curing of the UV ink is suppressed by mixing the silicon oil into the UV ink. As a result, it can be prevented that the UV ink in the uncured state is cured on the irradiation face so as to be fixed to the irradiation face.

The silicon oil has very low absorption efficiency (a ratio of the absorption amount of the ultraviolet ray that is absorbed by the silicon oil to the irradiation amount of the ultraviolet ray that is irradiated to the silicon oil) of the ultraviolet ray and has high capability for suppressing the curing of the UV ink for a case where the silicon oil is mixed with the UV ink in the uncured state. Accordingly, the silicon oil is appropriate as the cleaning solution that is used for preventing curing of the uncured UV ink on the irradiation face to be fixed to the irradiation face.

In addition, the silicon oil is supplied to the irradiation face before the blade 200 is brought into touch with the irradiation face. Accordingly, the friction for a case where the blade 200 is brought into touch with the irradiation face decreases, and therefore the blade 200 can be brought into touch with the irradiation face appropriately. In other words, the silicon oil adhering to the irradiation face serves as a lubricant, and accordingly, the blade 200 can be brought into touch with the irradiation face.

The cleaning solution supplying unit 220 is installed to the inside of the rotary drum 20. In addition, the cleaning solution supplying unit 220 has a cleaning solution injecting nozzle 222 that is included inside the indentation 23. This cleaning solution injecting nozzle 222 is located in front of the blade 200 (more precisely, on the downstream side of the blade 200 in the rotation direction of the rotary drum 20).

In addition, the cleaning solution supplying unit 220 has a storage section for the silicon oil and an injection mechanism that is used for injecting the silicon oil inside the storage section from the cleaning solution injecting nozzle 222. The operation (particularly, operation of injecting the cleaning solution by using the injection mechanism) of the cleaning solution supplying unit 220 is controlled by the sub controller 104 (see FIG. 6). When the cleaning solution injecting nozzle 222 moves to the position facing the irradiation face in accordance with the rotation of the rotary drum 20, the sub controller 104 allows the injection mechanism to inject the silicon oil inside the storage section from the cleaning solution injecting nozzle 222 toward the irradiation face. As a result, the silicon oil is supplied to the irradiation face, and the silicon oil adheres to the irradiation face.

Here, the position for facing the irradiation face indicates a position located during the cleaning solution injecting nozzle 222 faces the irradiation face in the rotation direction of the rotary drum 20. In addition, the position for facing the irradiation face changes in the range from a position of the cleaning solution injecting nozzle 222 for starting to face the irradiation face on the uppermost stream side to a position of the cleaning solution injecting nozzle 222 for completing to face the irradiation face on the downmost stream side.

In addition, according to this embodiment, a compound (so-called polymerization inhibitor) that has radical supplement capability and inhibits radical polymerization is added to the silicon oil that is used as the cleaning solution. Accordingly, an advantage of suppressing curing of the UV ink adhering to the irradiation face in the uncured state is exhibited more effectively. As the polymerization inhibitor, hydroquinones, catechols, hindered amines, phenols, phenothiazines, quinones of a fused aromatic ring, or the like may be used.

The blade cleaning unit 210 is used for removing the UV ink adhering to the blade 200 at a time when the blade 200 is brought into touch with the irradiation face and removes the UV ink from the irradiation face. This blade cleaning unit 210 removes the UV ink adhering to the blade 200. Thus, when the blade 200 passes the touching position for touching the irradiation face and reaches the touching position again, the blade 200 is brought into touch with the irradiation face in a state in which the adhering UV ink is removed. Accordingly, it can be prevented that the UV ink adhering to the blade 200 at a time when the blade 200 removes the UV ink from the irradiation face adheres to the irradiation face again.

The blade cleaning unit 210 is located on the downstream side of the UV irradiation unit 40 in the rotation direction of the rotary drum 20. The blade cleaning unit 210 is brought into touch with the blade 200 that passes the touching position for touching the irradiation face by a sponge part 210*a* included in the blade cleaning unit 210, in accordance with rotation of the rotary drum 20. This sponge part 210*a* is swollen due to the silicon oil serving as the cleaning solution and is continuously brought into touch with the blade 200 from one end of the blade 200 in the longitudinal direction to the other end thereof.

Then, when the blade cleaning unit 210 is brought into contact with the blade 200 by the sponge part 210*a*, the silicon oil inside the sponge part 210*a* flows out due to contact pressure applied from the blade 200. Accordingly, the silicon oil flows to the blade 200 side and adheres to the surface (more precisely, the contact face 201) of the blade 200. As a result, the UV ink adhering to the blade 200 flows to be washed out by the silicon oil. In other words, when the blade 200 moves from the touching position for touching the irradiation face to a contact position for contacting the sponge part 210*a* so as to be brought into contact with the sponge part 210*a* in accordance with the rotation of the rotary drum 20, the blade cleaning unit 210 cleans the blade 200 by using the silicon oil and removes the UV ink adhering to the blade 200.

Here, the contact position for contacting the sponge part 210*a* indicates a position of the blade 200 that is located during the blade 200 is brought into contact with the sponge part 210*a* in the rotation direction of the rotary drum 20. Since the sponge part 210*a* has a constant width in the rotation direction, the contact position changes in the rotation direction after the blade 200 starts to be brought to contact with the sponge part 210*a* until the contact between the blade 200 and the sponge part 210*a* is completed.

When the blade 200 reaches the touching position for touching the irradiation face of the UV irradiation unit 40 again in accordance with the rotation of the rotary drum 20 after passing the contact position for contacting the sponge part 210*a* (that is, after a cleaning operation for the blade 200 is performed by using the blade cleaning unit 210), the silicon oil adheres to the surface of the blade 200. Accordingly, when the blade 200 is brought into touch with the irradiation face again, friction between the blade 200 and the irradiation face is decreased. As a result, the blade 200 is brought into touch with the irradiation face in a smooth manner.

In addition, the blade 200 is brought into touch with the irradiation face again in a state in which the silicon oil adheres to the surface of the blade 200. Accordingly, even when the UV ink removed from the irradiation face adheres to the blade 200 at that moment, the UV ink can be easily removed from the blade 200 by using the blade cleaning unit 210. In addition, even when the UV ink in the uncured state adheres to the blade 200 at a time when the blade 200 is brought into touch with the irradiation face, the silicon oil adhering to the blade 200 is mixed into the UV ink, and accordingly, curing of the UV ink is suppressed. Accordingly, it can be prevented that the UV ink in the uncured state that adheres to the blade 200 is fixed to the blade 200. In addition, according to this embodiment, the polymerization inhibitor is added to the silicon oil located inside the sponge part 210*a*. Thus, the advantage of suppressing curing of the UV ink that adheres to the blade 200 in the uncured state is exhibited more effectively.

In addition, since the UV ink adhering to the blade 200 is removed, the blade 200 can be brought into touch with the irradiation face with a constant contact pressure maintained. Described in more details, the contact pressure of the blade 200 at a time when the blade 200 is brought into touch with the irradiation face in a state in which the UV ink adheres to the blade 200 changes from the contact pressure before adherence of the UV ink. In addition, as described above, the part of the blade 200 that is brought into touch with the irradiation face changes in the longitudinal direction of the blade 200 in accordance with the movement of the UV irradiation unit 40 in the scanning direction. When the part of the blade 200 that is brought into touch with the irradiation face changes, the adherence amount of the UV ink may change. Accordingly, when the blade 200 is continuously brought into touch with the irradiation face in a state in which the UV ink adheres to the blade 200, the adherence amounts of the UV ink may be non-uniform among each parts of the blade 200 in the longitudinal direction. As a result, the contact pressure of each part of the blade 200 in the longitudinal direction is non-uniform. On the other hand, according to this embodiment, the UV ink adhering to the blade 200 is removed until the blade 200 moves to the touching position again after the blade passes through the touching position for touching the irradiation face in accordance with the rotation of the rotary drum 20. Therefore, the blade 200 is brought into touch with the irradiation face appropriately without causing the above-described problems.

Next, an example of the operation of removing the UV ink adhering to the irradiation face of the UV irradiation unit 40 by using the above-described member will be described.

According to this embodiment, the operation of removing the UV ink is performed during the above-described printing operation. Described in more details, during the printing operation, the operation of removing the UV ink is started from an area in which the non-holding area 22*b* reaches the position for facing the irradiation face of the UV irradiation unit 40 in accordance with rotation of the rotary drum 20. When the rotary drum 20 rotates after the non-holding area 22*b* faces the irradiation face, first, the cleaning solution injecting nozzle 222 moves up to the position (facing position) for facing the irradiation face of the UV irradiation unit 40.

When the cleaning solution injecting nozzle 222 reaches the facing position, the silicon oil is injected from the cleaning solution injecting nozzle 222 toward the irradiation face. Accordingly, the silicon oil is supplied to the irradiation face, and thus, the silicon oil adheres to the irradiation face. In addition, since supply of the silicon oil to the irradiation face is performed by injection from the cleaning solution injecting nozzle 222, the silicon oil adheres to the irradiation face appropriately.

When the rotary drum 20 rotates further after the cleaning solution supplying unit 220 started to supply the silicon oil to the irradiation face, the blade 200 moves to the touching position for touching the irradiation face so as to be brought into touch with the irradiation face in the touching face 201. Described in more details, after the cleaning solution injecting nozzle 222 moves to the facing position for facing the irradiation face in accordance with the rotation of the rotary drum 20 and injects the silicon oil to the irradiation face (that is, after the silicon oil is supplied by the cleaning solution supplying unit 220), the blade 200 moves to the position for touching the irradiation face to which the silicon oil is supplied in accordance with the rotation of the rotary drum 20.

Then, the blade 200 moves in the rotation direction of the rotary drum 20 with the state, in which the blade is brought into touch with the irradiation face in the touching face 201, maintained, and whereby the UV ink adhering to the irradiation face is scraped out and removed.

According to this embodiment, irradiation of the ultraviolet ray from the UV irradiation unit 40 is stopped while the blade 200 is brought into touch with the irradiation face (that is, while the blade 200 is located in the touching position). When the UV irradiation unit 40 continues to irradiate the ultraviolet ray while the blade 200 is brought into touch with the irradiation face, the UV ink adhering to the blade 200 may be cured. In such a case, the UV ink may be fixed to the blade 200. The control process for stopping irradiation of the ultraviolet ray, for example, is performed by the sub controller 104 based on the position in which the rotary drum 20 is located in the rotation direction of the rotary drum 20. As a sensor for detecting the position of the blade 200 in the rotation direction, for example, a rotary encoder that is installed to the rotation shaft 21 of the rotary drum 20 or the like may be used.

After the blade 200 is brought into touch with the irradiation face in the touching position, the blade 200 passes through the touching position in accordance with the rotation of the rotary drum 20 and moves to the downstream side of the touching position in the rotation direction of the rotary drum 20 further. Then, the blade 200 moves up to the contact position for contacting the sponge part 210*a* of the blade cleaning unit 210 so as to be brought into contact with the sponge part 210*a*. At this moment, the silicon oil flowing out from the sponge part 210*a* adheres to the blade 200, and the UV ink adhering to the touching face 201 of the blade 200 is washed out and flows. As described above, the blade cleaning unit 210 cleans the blade 200 with the silicon oil, and thereby the UV ink adhering to the blade 200 is removed appropriately.

Thereafter, the blade 200 passes through the contact position for contacting the sponge part 210*a* in accordance with the rotation of the rotary drum 20. Then, when the rotary drum 20 rotates further and moves up to the position in which the non-holding area 22*b* faces the irradiation face again, the above-described operations are performed again. Until the blade 200 moves to the touching position for touching the irradiation face in accordance with the rotation of the rotary drum 20 after the blade 200 reaches the touching position for touching the irradiation face, the UV irradiation unit 40 moves in the scanning direction. In accompaniment with the movement of the UV irradiation unit 40, a part that is brought into touch with the irradiation face of the blade 200 is deviated from the blade 200 in the longitudinal direction of the blade (a direction following the scanning direction) by a moving distance of the UV irradiation unit 40.

During the printing operation, when the non-holding area 22*b* moves to the position for facing the irradiation face of the UV irradiation unit 40 in accordance with the rotation of the rotary drum 20, a series of the above-described operations is performed repeatedly. Accordingly, the irradiation face of the UV irradiation unit 40 is maintained in a state in which the UV ink does not adhere to the irradiation face.

As described above, according to this embodiment, the UV ink adhering to the irradiation face is mechanically removed by bring the blade 200 to be in touch with the irradiation face by using the rotation of the rotary drum 20. In other words, the configuration of this embodiment is a simple configuration for removing the UV ink adhering to the irradiation face. As a result, the printer 10 of which irradiation face can be maintained clean without requiring a complicated control process is implemented.

Other Embodiments

As above, the printer as an example of the ink injecting apparatus has been described based on the embodiments. However, the above-described embodiments of the invention are for gaining a sufficient understanding of the invention and should not be considered for purposes of limiting the invention. It is apparent that the invention may be changed or modified without departing from the gist of the invention and equivalents thereof belong to the scope of the invention.

Modified Examples of Cleaning Solution Supplying Unit

Figure 7:
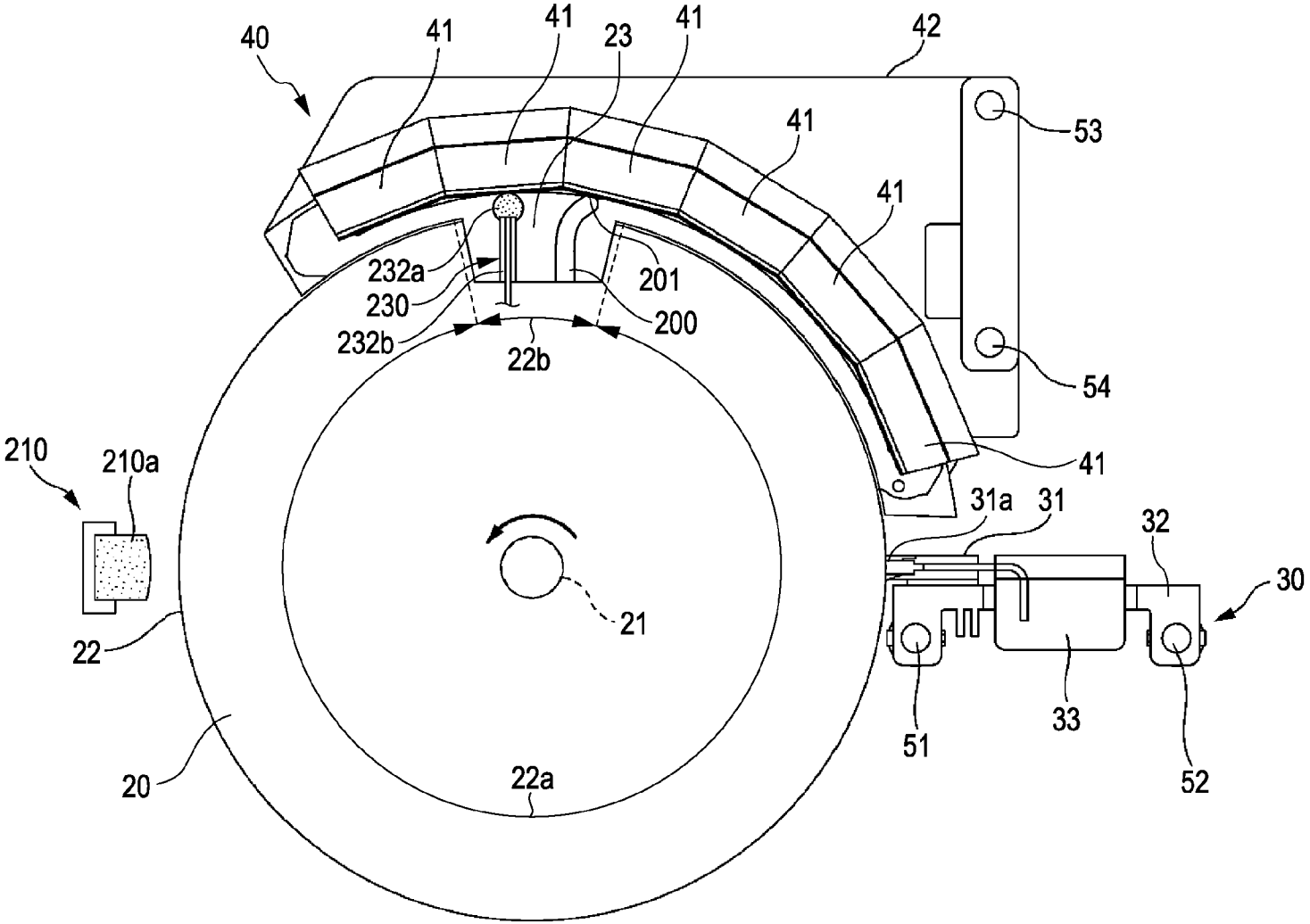
FIG. 7 is a diagram showing another cleaning solution supplying unit 230 according to an embodiment of the invention.

In the above-described embodiments, the cleaning solution supplying unit 220 is configured to include the cleaning solution injecting nozzle 222. In addition, after the cleaning solution injecting nozzle 222 moves to the facing position for facing the irradiation face in accordance with the rotation of the rotary drum 20 and injects the silicon oil toward the irradiation face, the blade 200 is configured to be brought into touch with the irradiation face. However, a cleaning solution supplying unit according to an embodiment of the invention is not limited to the cleaning solution supplying unit 220 of the above-described embodiments. Thus, for example, another cleaning solution supplying unit 230 as shown in FIG. 7 may be considered to be used. FIG. 7 is a diagram showing another cleaning solution supplying unit 230.

The cleaning solution supplying unit 230 has a protrusion part 232 that is disposed in the non-holding area 22*b* of the circumferential face 22 of the rotary drum 20 and protrudes from the non-holding area 22*b* toward the outer side of the rotary drum 20. This protrusion part 232 is located in front of the blade 200 inside the indentation 23. A front end portion 232*a* of the protrusion part 232 is formed of sponge containing silicon oil. In addition, the cleaning solution supplying unit 230 includes a storage part for silicon oil and a humidifying mechanism that is used for guiding silicon oil from the storage part to the front end portion 232*a* of the protrusion part 232 and moisturizing the front end portion 232*a* (the storage part and the humidifying mechanism are not shown in the figure). By using the humidifying mechanism, the front end portion 232*a* of the protrusion part 232 is maintained in a moisturized state with the silicon oil all the time.

The protrusion part 232 moves to the contact position for contacting the irradiation face of the UV irradiation unit 40 in accordance with the rotation of the rotary drum 20 so as to be brought into contact with the irradiation face in the contact position by the front end portion 232*a*. In other words, the protrusion amount of the protrusion part 232 is configured to be slightly larger than a distance from the bottom face of the indentation 23 to the irradiation face for a case where the indentation 23 faces the irradiation face. Accordingly, the protrusion part 232 moves to the contact position for contacting the irradiation face in the front end portion 232*a* in accordance with the rotation of the rotary drum 20. Here, the contact position for contacting the irradiation face indicates a position located during the protrusion part 232 is brought into contact with the irradiation face in the front end portion 232*a* in the rotation direction of the rotary drum 20. The contact position changes in the range from a position of the protrusion part 232 at a time when the protrusion part 232 starts to be brought into contact with the irradiation face on the uppermost stream side to a position of the protrusion part 232 at a time when the protrusion part 232 completes to be brought into contact with the irradiation face on the downmost stream side.

By bringing the front end portion 232*a* of the protrusion part 232 into contact with the irradiation face, the silicon oil inside the front end portion 232*a* is supplied so as to coat the irradiation face. Thereafter, the blade 200 moves to the touching position for touching the irradiation face in accordance with the rotation of the rotary drum 20 and is brought into contact with the irradiation face. In other words, after the protrusion part 232 moves to the contact position for contacting the irradiation face in accordance with the rotation of the rotary drum 20 and is brought into contact with the irradiation face (that is, after the cleaning solution supplying unit 230 supplies the silicon oil), the blade 200 moves to the position for touching the irradiation face to which the silicon oil is supplied in accordance with the rotation of the rotary drum 20 and is brought into touch with the irradiation face. Even in a case where the above-described cleaning solution supplying unit 230 is disposed, the same advantages as those of the above-described embodiments can be acquired.

In the above-described embodiments, in order to remove the UV ink adhering to the blade 200, the sponge part 210*a* that is swollen with the silicon oil is brought into contact with the blade 200 by using the blade cleaning unit 210, and thereby the blade 200 is cleaned using the silicon oil. However, the invention is not limited thereto. For example, it may be configured that the blade cleaning unit 210 has a storage tank for silicon oil and the blade 200 is cleaned by immersing the blade 200 in the silicon oil inside the storage tank. Alternatively, it may be configured that the blade cleaning unit 210 has an injection nozzle that injects the silicon oil and the blade 200 is cleaned by injecting the silicon oil from the injection nozzle toward the blade 200.

Configuration in which Protrusion Amount of Blade 200 can be Changed

In the above-described embodiments, the blade 200 is configured to be brought into touch with the irradiation face of the UV irradiation unit 40 in a state in which the blade 200 protrudes toward the outer side in the diameter direction of the rotary drum 20. In the above-described embodiments, the protrusion amount of the blade 200 is invariable. The rotary drum 20 rotates while disposing the circumferential face 22 to face the irradiation face and the nozzle face 31*a*. Accordingly, the blade 200 moves to the touching position for touching the irradiation face in accordance with the rotation of the rotary drum 20, and simultaneously, the blade 200 moves to the facing position for facing the nozzle face 31*a*. Here, the facing position for facing the nozzle face 31*a* indicates a position in which the blade 200 faces the nozzle face 31*a* in the rotation direction of the rotary drum 20.

Here, a gap between the circumferential face 22 of the rotary drum 20 and the irradiation face and a gap between the circumferential face 22 and the nozzle face 31*a* may be different from each other. In particular, in order to land ink in a paper sheet with high precision for printing an image, the gap between the circumferential face 22 and the nozzle face 31*a* may be configured to be smaller than the gap between the circumferential face 22 and the irradiation face. In such a case, the protrusion amount of the blade 200 is invariable, and the blade 200 moves to the facing position for facing the nozzle face 31*a* with the protrusion amount for bringing the blade 200 into touch with the irradiation face maintained. Accordingly, the blade 200 is brought into touch with up to the nozzle face 31*a*. In such a case, injecting of ink from the nozzle is disturbed.

Thus, as a configuration different from those of the above-described embodiments, a configuration in which the protrusion amount of the blade 200 can be changed and the blade 200 is brought into touch with not the nozzle face 31*a* but only the irradiation face may be considered. Hereinafter, several examples (a first example to a fourth example) of the configuration in which the protrusion amount of the blade can be changed will be described.

FIRST EXAMPLE

Figure 8A:
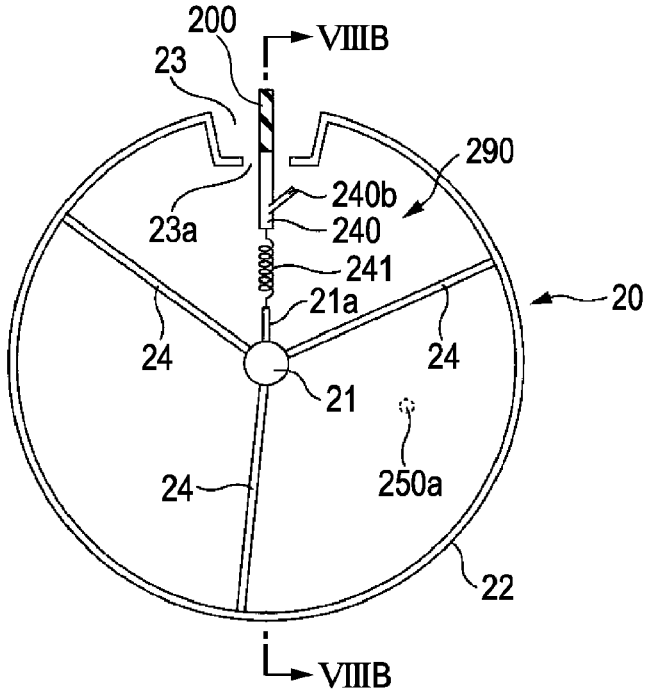
FIG. 8A is a cross-section view of a rotary drum 20 according to a first example taken along a line in the shaft direction.
Figure 8B:
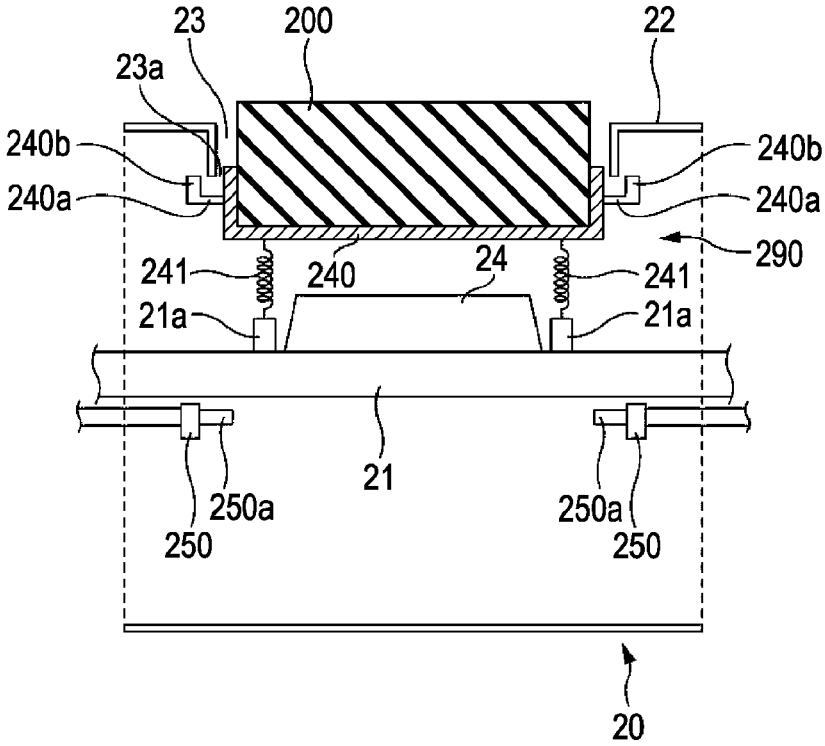
FIG. 8B is a cross-section view taken along line VIIIB-VIIIB shown in FIG. 8A.

First, the first example will be described with reference to FIGS. 8A and 8B. FIG. 8A is a cross-section view (cross-section view having the shaft direction of the rotary shaft 21 as the direction of a normal line) of the rotary drum 20 according to the first example taken along a line in the shaft direction. FIG. 8B is a cross-section view taken along line VIIIB-VIIIB shown in FIG. 8A.

In the first example, the rotary drum 20 has a hollow body, and both ends of the rotary drum 20 in the shaft direction are open. The rotation shaft 21 of the rotary drum 20 is a shaft having a cylindrical shape that is communicated with the inside of the rotary drum 20. As shown in FIG. 8A, the rotation shaft 21 is supported by shaft supporting parts 24 that extend from the inner circumferential face of the rotary drum 20 toward the center of the rotary drum 20.

In the non-holding area 22*b* (more particularly, the bottom face of the above-described indentation 23) of the circumferential face 22 of the rotary drum 20, an opening 23*a* that is used for protruding the blade 200 to the outside of the rotary drum 20 is formed (see FIGS. 8A and 8B).

In addition, in the first example, a change mechanism 290 that changes the protrusion amount of the blade 200 is included. Particularly, the change mechanism 290 in this example changes the protrusion amount of the blade 200 by using rotation of the rotary drum 20. Described in detail for the change mechanism 290, the change mechanism 290, as shown in FIGS. 8A and 8B includes a blade frame 240 that is attached to the blade 200, a spring body 241 that biases the blade 200 to the outside in the diameter direction of the rotary drum 20, and a pressing part 250 that presses the blade 200 to the inner side (center side) of the rotary drum 20 in the diameter direction.

The blade frame 240 is a frame that encloses the lower half part of the outer frame of the blade 200. Most of the blade frame 240 is located inside the rotary drum 200. Both end parts of the blade frame 240 form an approximate letter "L". In particular, in each end part, an extraction part 240*a* that extends to the outer side of the rotary drum 20 in the shaft direction and a cross part 240*b* that crosses the extraction part 240 are formed (see FIG. 8B). In addition, the upper end side (the outer side of the rotary drum 20 in the diameter direction) of the cross part 240*b* is tilted to lie down in a direction opposite to the rotation direction of the rotary drum 20 (see FIG. 9A).

The spring body 241 is housed inside the rotary drum 20. One end of the spring body 241 is fixed to the blade frame 240, and the other end of the blade frame 240 is fixed to the rotary drum 20. In the first example, the other end of the spring body 241 is fixed to a spring fixing part 21*a* that protrudes from a center part of the rotation shaft 21 of the rotary drum 20 in the shaft direction. As a result, the blade 200 and the blade frame 240 are fixed to the rotation shaft 21 through the spring body 241. Accordingly, when the rotation shaft 21 rotates, the rotary drum 20 rotates together with the rotation shaft 21.

The pressing part 250 is fixed to the printer main body and extends toward both ends of the rotary drum 20 in the shaft direction. Here, the printer main body is a part of the printer 10 excluding the rotary drum 20 from the printer 10. In this example, the pressing part 250 is fixed to the frame 12. The front end portion of the pressing part 250 intrudes inside the rotary drum 20 through both ends of the rotary drum 20 in the shaft direction that are open ends. In the front end portion of the pressing part 250, as shown in FIG. 8B, a protrusion 250*a* that protrudes toward the center part of the rotary drum 20 in the shaft direction is formed.

The pressing part 250 is fixed to the main body of the printer, and accordingly, the rotary drum 20 rotates relatively with respect to the pressing part 250. Then, the protrusion 250*a* of the pressing part 250 is in engagement with the cross part 240*b* of the blade frame 240 in accordance with the rotation of the rotary drum 20. When the rotary drum 20 rotates further in such a state, the pressing part 250 presses the blade 200 to the inner side of the rotary drum 200 in the diameter direction through the blade frame 240. As a result, the blade 200 moves to the center side of the rotary drum 20 in resistance to the biasing force of the spring body 240, and accordingly, the protrusion amount is decreased. The pressing part 250 is in contact with only the cross part 240*b* during the rotation of the rotary drum 20 and is not interrupted by other members (for example, the shaft supporting part 24).

Figure 9A:
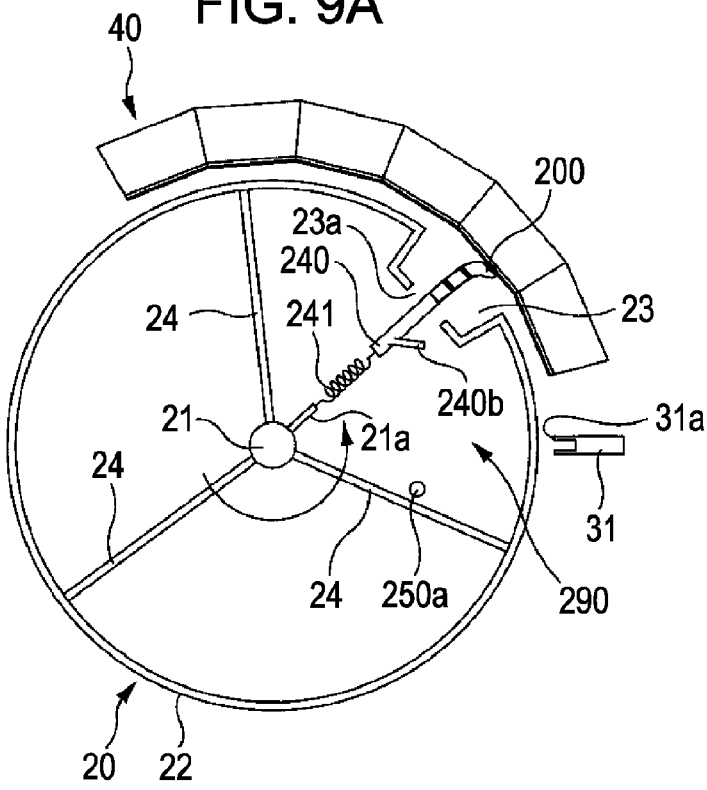
FIGS. 9A and 9B are diagrams showing the appearance in which the protrusion amount is changed in accordance with rotation of the rotary drum 20.
Figure 9B:
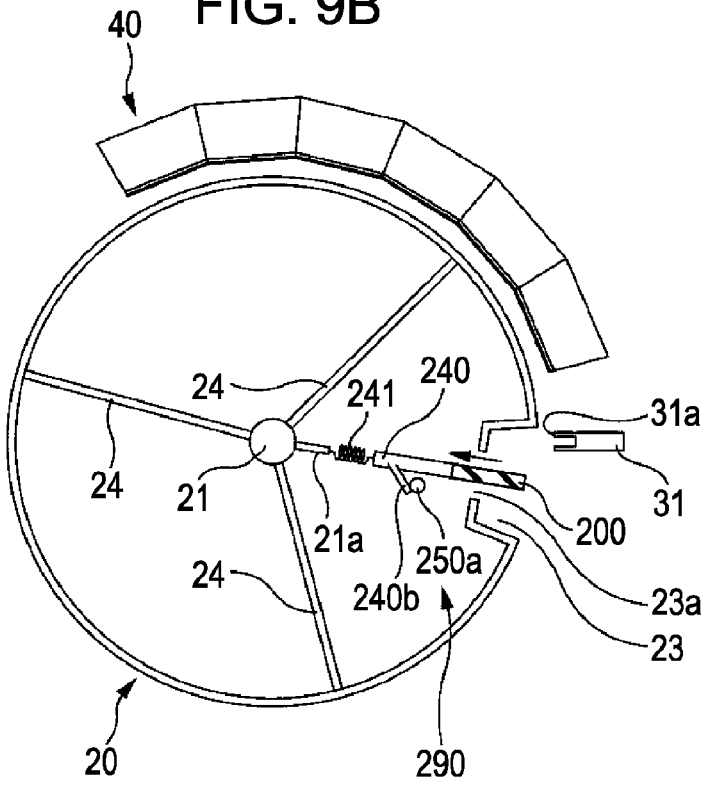

Since the above-described change mechanism 290 is included, the protrusion amount of the blade 200 changes in accordance with the rotation of the rotary drum 20. Hereinafter, the appearance in which the protrusion amount changes in accordance with the rotation of the rotary drum 20 will be described with reference to FIGS. 9A and 9B. FIGS. 9A and 9B are diagrams showing the appearance in which the protrusion amount is changed in accordance with rotation of the rotary drum 20.

In the middle of a period in which the rotary drum 20 rotates, while the protrusion 250*a* of the pressing part 250 is not engaged with the cross part 240*b* of the blade frame 240, the blade 200 is biased by the spring body 241 to be in a state in which the blade protrudes at a maximum protrusion amount in the changeable range. Then, in the above-described state, as shown in FIG. 9A, the blade 200 is located in a touching position for touching the irradiation face so as to be brought into touch with the irradiation face. In other words, so long as the blade 200 is not pressed by the pressing part 250, the above-described protrusion amount is enough to allow the blade 200 to be brought into touch with the irradiation face.

On the other hand, in the middle of the rotation of the rotary drum 20, when the protrusion 250*a* of the pressing part 250 is engaged with the cross part 240*b* of the blade frame 240, the pressing part 250 presses the blade 200 to the center side of the rotary drum 20. Accordingly, the blade 200 moves to the inner side of the rotary drum 20 in the diameter direction through the opening 23*a* that is formed in the non-holding area 22*b* of the circumferential face 22. As a result, the upper end (an end on the outer side of the rotary drum 20 in the diameter direction) of the blade 200 is located inside the indentation 23, and the protrusion amount becomes the minimum in the changeable range. During the above-described state, as shown in FIG. 9B, the blade 200 is located in a facing position for facing the nozzle face 31*a*. Then, while the blade 200 faces the nozzle face 31*a*, the pressing part 250 continues to press the blade 200. In other words, the pressing part 250 is disposed such that the protrusion 250*a* is engaged with the cross part 240*b* at a time when the blade 200 faces the nozzle face 31*a*. As a result, the blade 200 passes though the facing position for facing the nozzle face 31*a* without being brought into contact with the nozzle face 31*a*.

The above-described appearance will now be described again in a viewpoint of the change mechanism 290 side. When the blade 200 moves from a position located on the upstream side of the nozzle face 31*a* to a position for facing the nozzle face 31*a* in accordance with the rotation of the rotary drum 20, the change mechanism 290 changes the protrusion amount such that the blade 200 is not brought into touch with the nozzle face 31*a* by pressing the blade 200 by using the pressing part 250. In other words, when the blade 200 reaches the position for facing the nozzle face 31*a*, the change mechanism 290 changes the protrusion amount from a maximum to a minimum.

Thereafter, as the rotary drum 20 rotates further, the blade 200 moves from the position for facing the nozzle face 31*a* to the position for touching the irradiation face. During that period, engagement between the protrusion 250*a* of the pressing part 250 and the cross part 240*b* of the blade frame 240 is released (in other words, the cross part 240*b* is separated from the protrusion 250*a* in accordance with the rotation of the rotary drum 20). Accordingly, until the blade 200 passes through the position for facing the nozzle face 31*a* and reaches the position for touching the irradiation face, the protrusion amount is restored from the minimum to the maximum. In other words, when the blade 200 moves to the position for touching the irradiation face in accordance with the rotation of the rotary drum 20, the change mechanism 290 changes the protrusion amount such that the blade 200 is brought into touch with the irradiation face.

As described above, in this example, an adverse affect of ink injection from the nozzle that is caused by bringing the blade 200 into touch with the nozzle face 31*a* can be avoided by using the change mechanism 290. In addition, in the first example, since the protrusion amount is changed by using the rotation of the rotary drum 20, the protrusion amount can be changed by using a simple configuration without disposing an additional driving source that changes the protrusion amount.

SECOND EXAMPLE

Figure 10A:
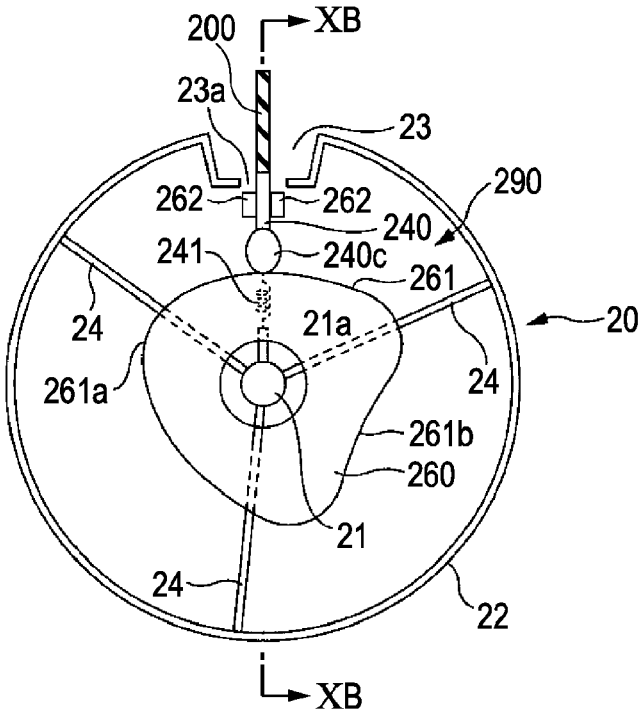
FIG. 10A is a cross-section view of a rotary drum 20 according to a second example taken along a line in the shaft direction.
Figure 10B:
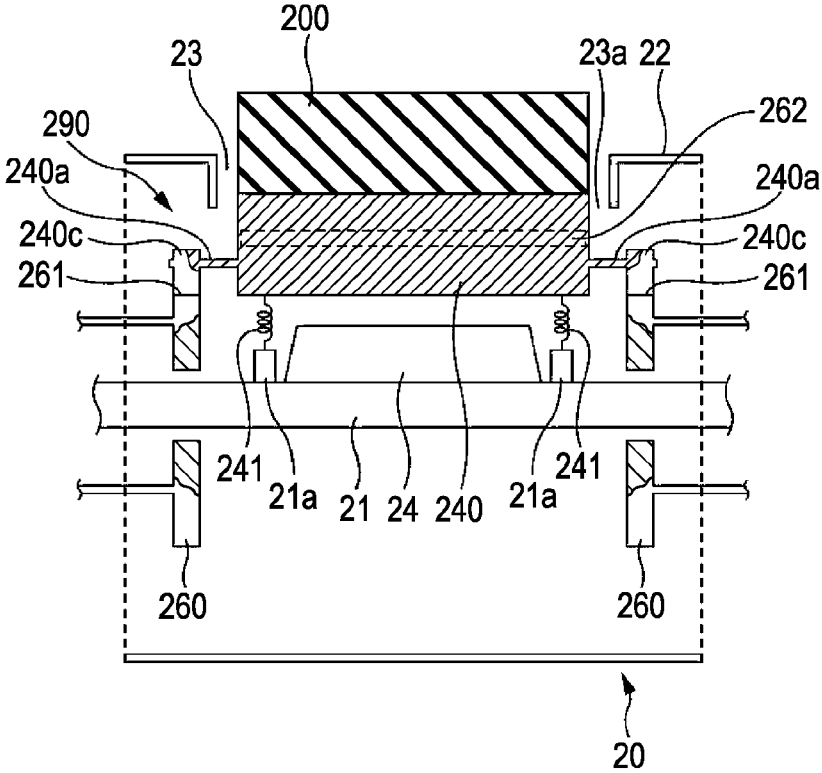
FIG. 10B is a cross-section view taken along line XB-XB shown in FIG. 10A.

Next, the second example will be described with reference to FIGS. 10A and 10B. FIG. 10A is a cross-section view of the rotary drum 20 according to the second example taken along a line in the shaft direction. FIG. 10B is a cross-section view taken along line XB-XB shown in FIG. 10A. Descriptions of duplicate parts in the configuration of the first example will be omitted here.

Also in the second example, the change mechanism 290 that changes the protrusion amount of the blade 200 by using rotation of the rotary drum 20 is included. The change mechanism 290 in this example, as shown in FIGS. 10A and 10B, includes the blade frame 240, the spring body 241, and a cam 260 of which cam face 261 that is used for moving the blade 20 along the diameter direction of the rotary drum 20 is formed in a circumferential face.

The blade frame 240 according to the second example has almost the same shape as that of the blade frame 240 according to the first example. On the other hand, as shown in FIGS. 10A and 10B, instead of the cross part 240*b*, a contact 240*c* in an approximately elliptic cylindrical shape is disposed. The contact 240*c* slides on the cam face 261 while contacting the cam face 261 of the cam 260 in accordance with rotation of the rotary drum 260.

The spring body 241 is disposed in a position that is the same as that of the spring body 241 according to the first example. However, the function of the spring body 241 is different from that of the spring body 241 according to the first example. In particular, the spring body 241 according to the second example pulls the blade 200 and the blade frame 240 to the inner side of the rotary drum 20 in the diameter direction for maintaining a contact state between the contact 240*c* and the cam face 261 of the cam 260.

The cam 260 has an almost heart shape, and the cam 260 is housed in the rotary drum 20 such that the center of the cam 260 coincides with the center of the rotary drum 20. In the center part of the cam 260, a hole having a diameter that is slightly larger than the outer diameter of the rotation shaft 21 of the rotary drum 20 is formed. Thus, the rotation shaft 21 passes through the hole with a gap interposed therebetween. In addition, the cam 260 is fixedly supported by the main body of the printer (in particular, the frame 12). Thus, when the rotary drum 20 rotates, the cam 260 rotates relatively with respect to the rotary drum 20.

Then, when the cam 260 rotates relatively with respect to the rotary drum 260, the contact 240*c* moves along the outer circumferential face (cam face 261) of the cam 260. Accordingly, the blade 200 and the blade frame 240 move along the diameter direction of the rotary drum 20. At this moment, the blade frame 240, as shown in FIG. 10A is fitted into one pair of guide members 262 and slides between the guide members. As a result, the moving direction of the blade 200 and the blade frame 240 is regulated so as to follow the diameter direction of the rotary drum 20 by one pair of the guide members 262.

When the contact 240*c* slides on a face (hereinafter, referred to as an outermost face 261*a*) of the cam face 261 that is farthest from the center of the cam 260, the blade 200 and the blade frame 240 reach a top dead point (a position located on the outermost side of the rotary drum 20 in the diameter direction) of the moving range. At this moment, the protrusion amount of the blade 200 is a maximum in the changeable range. On the other hand, when the contact 240*c* slides on a face (hereinafter, referred to as an innermost face 261*b*) of the cam face 261 that is located closest to the center side of the cam 260, the blade 200 and the blade frame 240 reach a bottom dead point (a position located on the innermost side in the diameter direction) in the moving range. At this moment, the protrusion amount of the blade 200 is a minimum in the changeable range.

According to the above-described change mechanism 290, when the blade 200 moves to the position for touching the irradiation face in accordance with rotation of the rotary drum 20, the contact 240*c* slides near the outermost face 261*a*. As a result, the blade 200 passes through the touching position while maintaining the protrusion amount that is enough for allowing the blade 200 to be brought into touch with the irradiation face. In other words, the blade 200 is brought into touch with the irradiation face appropriately. On the other hand, when the blade 200 moves to the position for facing the nozzle face 31*a* in accordance with rotation of the rotary drum 20, the contact 240*c* slides near the innermost face 261*b*. As a result, from start of the blade 200 for facing the nozzle face 31*a* to completion of the blade 200 for facing the nozzle face 31*a*, the blade 200 maintains the protrusion amount for which the blade 200 is not brought into touch with the nozzle face 31*a*. In other words, the blade 200 passes through the position for facing the nozzle face 31*a* without being brought into touch with the nozzle face 31*a*.

As described above, also in the second example, as in the first example, the change mechanism 290 changes the protrusion amount such that the blade 200 is brought into touch with the irradiation face at a time when the blade 200 moves to the position for touching the irradiation face in accordance with rotation of the rotary drum 20 and the blade 200 is not brought into touch with the nozzle face 31*a* at a time when the blade 200 is located in the position for facing the nozzle face 31*a* in accordance with rotation of the rotary drum 20.

THIRD EXAMPLE

Figure 11A:
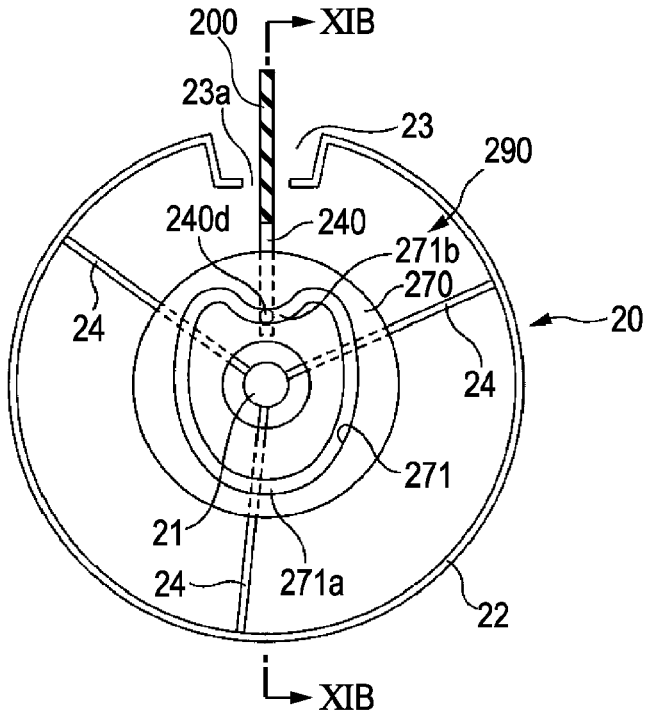
FIG. 11A is a cross-section view of a rotary drum 20 according to a third example taken along a line in the shaft direction.
Figure 11B:
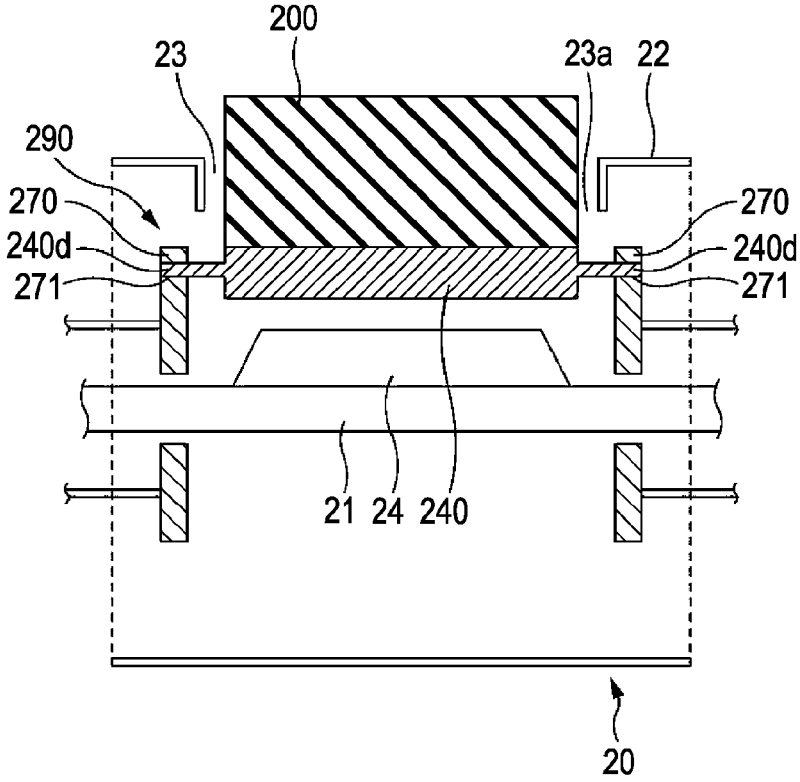
FIG. 11B is a cross-section view taken along line XIB-XIB shown in FIG. 11A.

Next, the third example will be described with reference to FIGS. 11A and 11B. FIG. 11A is a cross-section view of the rotary drum 20 according to the third example taken along a line in the shaft direction. FIG. 11B is a cross-section view taken along line XIB-XIB shown in FIG. 11A. Descriptions of duplicate parts in the configurations of the first and second examples will be omitted here.

Also in the third example, the change mechanism 290 that changes the protrusion amount of the blade 200 by using rotation of the rotary drum 20 is included. The change mechanism 290 in this example, as shown in FIGS. 11A and 11B, includes the blade frame 240 and a groove cam 270 in which a groove 271 for moving the blade 200 in the diameter direction of the rotary drum 20 is formed.

The configuration of the third example is almost the same as that of the second example. The groove cam 270 is responsible for a function that is the same as that of the cam body 260. In other words, engagement protrusions 240*d* that move along the grooves 271 while being engaged with the grooves 271 of the groove cams 270 are formed on both end parts of the blade frame 240, and as the engagement protrusions 240*d* move along the grooves 271, the blade 200 and the blade frame 240 move along the diameter direction of the rotary drum 20. In addition, the groove cam 270 is housed in the rotary drum 20 in a state in which the groove cam 270 is fixed to the main body of the printer. Accordingly, when the rotary drum 20 rotates, the groove cam 270 rotates relatively with respect to the rotary drum 20.

When the engagement protrusion 240*d* moves through the outermost part 271*a* (see FIG. 11A) of the groove 271 that is located on the outermost side of the rotary drum 20 in the diameter direction, the blade 200 and the blade frame 240 reach a top dead point in the moving range, and accordingly, the protrusion amount of the blade 200 becomes a maximum in the changeable range. On the other hand, when the engagement protrusion 240*d* moves through the innermost part 271*b* (see FIG. 11A) of the groove 271 that is located on the innermost side of the rotary drum 20 in the diameter direction, the blade 200 and the blade frame 240 reach a bottom dead point in the moving range, and accordingly, the protrusion amount of the blade 200 becomes a minimum in the changeable range.

As described above, also in the third example, the change mechanism 290 changes the protrusion amount such that the blade 200 is brought into touch with the irradiation face at a time when the blade 200 moves to the position for touching the irradiation face in accordance with rotation of the rotary drum 20 and the blade 200 is not brought into touch with the nozzle face 31*a* at a time when the blade 200 is located in the position for facing the nozzle face 31*a* in accordance with rotation of the rotary drum 20.

FOURTH EXAMPLE

Figure 12A:
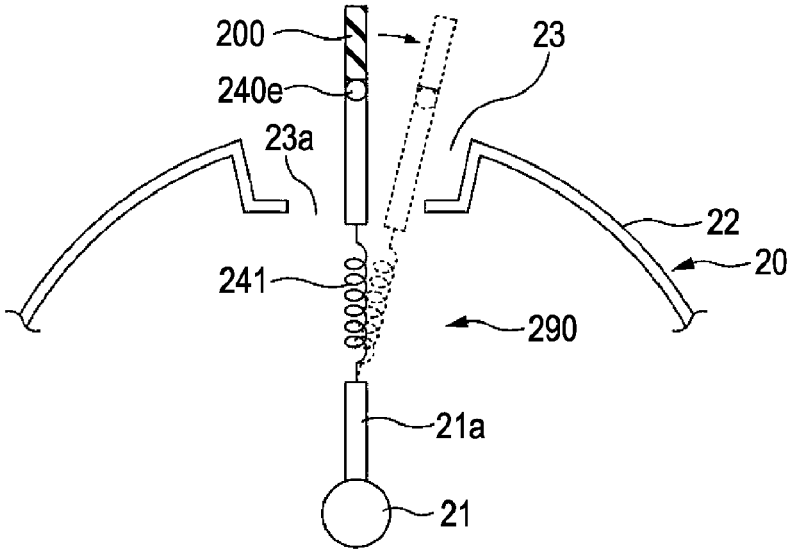
FIG. 12A is a diagram showing the vicinity of a blade 200 according to a fourth example.
Figure 12B:
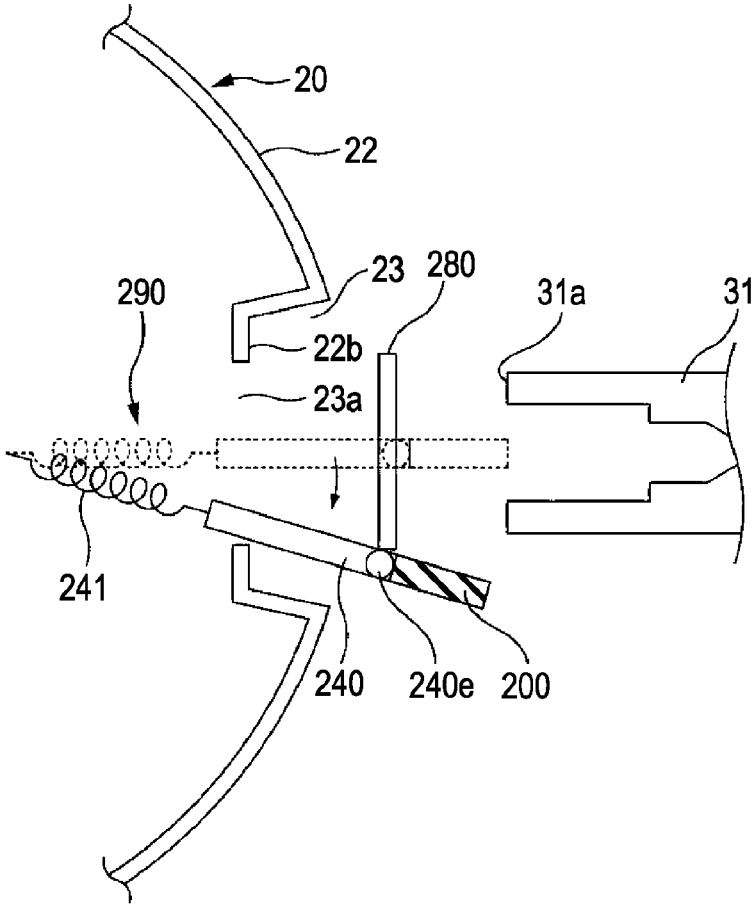
FIG. 12B is a diagram showing the appearance of the blade 200 that moves to a position for facing a nozzle face 31*a*.

Next, the fourth example will be described with reference to FIGS. 12A and 12B. FIG. 12A is a diagram showing the vicinity of the blade 200 according to the fourth example and is a cross-section view of the rotary drum 20 taken along a line in the shaft direction. FIG. 12B is a diagram showing the appearance of the blade 200 that moves to the position for facing the nozzle face 31*a*. Descriptions of duplicate parts in the configurations of the first to third examples will be omitted here.

In the fourth example, an opening 23*a* that is installed in the non-holding area 22*b* of the circumferential face 22 of the rotary drum 20 is formed such that the length in the circumferential direction of the rotary drum 20 is slightly long (see FIG. 12A). Also in the fourth example, the change mechanism 290 that changes the protrusion amount of the blade 200 by using rotation of the rotary drum 20 is included. The change mechanism 290, as shown in FIG. 12A, includes a second pressing part 280 that presses the blade frame 240, the spring body 241, and the blade 200 to fall down in a direction opposite to the rotation direction of the rotary drum 20.

Most of the blade frame 240 according to the fourth example is located on the outer side of the rotary drum 20 relative to the opening 23*a*. In addition, in each of both end parts of the blade frame 240, a protrusion 240*e* grown to the outer side of the rotary drum 20 in the shaft direction is formed. A distance from the center of the rotary drum 20 to the protrusion 240*e* is longer than the outer diameter (in particular, the outer diameter of the holding area 22*a* of the circumferential face 22) of the rotary drum 20. In other words, the protrusion 240*e* is disposed outside the rotary drum 20.

The spring body 241 according to the fourth example, same as the spring body 241 according to the first example, biases the blade 200 to the outer side of the rotary drum 20 in the diameter direction. The second pressing part 280 is a member that is installed outside the rotary drum 20 and is fixedly supported by the main body of the printer (for example, the side face of the head 31). When the blade 200 moves to the position for facing the nozzle face 31*a* in accordance with rotation of the rotary drum 20, the second pressing part 280 is engaged with the protrusion 240*e* of the blade frame 240. When the rotary drum 20 rotates further in such a state, as shown in FIG. 12B, the second pressing part 280 presses the blade 200 so as to fall down in the direction opposite to the rotation direction of the rotary drum 20 by using the other end of the spring body 241 as a fulcrum point. As the second pressing part 280 presses the blade 200 as described above, as shown in FIG. 12B, the position of the upper end (an outer side end of the rotary drum 20 in the diameter direction) of the blade 200 is displaced toward the center side of the rotary drum 20. In other words, the protrusion amount of the blade 200 decreases.

According to the fourth example in which the above-described change mechanism 290 is included, during a period in which the rotary drum 20 rotates, while the blade 200 does not face the nozzle face 31*a*, the blade 200 is biased by the spring body 241 in one direction in which the blade 200 is not pressed by the second pressing part 280, and a state in which the blade 200 protrudes by a sufficient protrusion amount is formed. In such a case, the blade 200 is located in the position for touching the irradiation face and is brought into touch with the irradiation face.

On the other hand, during the rotation of the rotary drum 20, when the blade 200 moves to the position for facing the nozzle face 31*a*, the second pressing part 280 is engaged with the protrusion 240*e* of the blade frame 240 so as to press the blade 200. Accordingly, the blade 200 falls down in the direction opposite to the rotation direction of the rotary drum 20. In other words, the blade 200 moves from a position denoted by a broken line shown in FIG. 12B to a position denoted by a solid line shown in FIG. 12B. As a result, the protrusion amount decreases such that the blade 200 is not brought into touch with the nozzle face 31*a*. While the blade 200 faces the nozzle face 31*a*, the protrusion amount of the blade 200 is maintained such that the blade 200 is not brought into touch with the nozzle face 31*a*.

As described above, also in the fourth example, when the blade 200 moves to the position for facing the nozzle face 31*a* in accordance with rotation of the rotary drum 20, the change mechanism 290 changes the protrusion amount such that the blade 200 is not brought into touch with the nozzle face 31*a*. Thereafter, when the blade 200 moves from the position for facing the nozzle face 31*a* to the position for touching the irradiation face in accordance with further rotation of the rotary drum 20, the change mechanism 290 changes the protrusion amount such that the blade 200 is brought into touch with the irradiation face.

What is claimed is:

1. An ink injecting apparatus comprising:

a nozzle that is used for injecting ultraviolet-curable ink to a medium;

an irradiation unit that includes an irradiation face for irradiating an ultraviolet ray to the ultraviolet-curable ink adhering to the medium;

a rotary body that has a holding area for holding the medium and a non-holding area on a circumferential face, rotates with the circumferential face facing the irradiation face, and includes a touch member that moves to a position for touching the irradiation face and is brought into touch with the irradiation face in the non-holding area in accordance with rotation of the rotary body for removing the ultraviolet-curable ink adhering to the irradiation face, wherein a length of the touch member in a longitudinal direction is longer than a length of the irradiation unit in a scanning direction; and a cleaning solution supplying unit that supplies a cleaning solution to the irradiation face for adhering the cleaning solution to the irradiation face, wherein the touch member moves to the position for touching the irradiation face and is brought into touch with the irradiation face in accordance with rotation of the rotary body after the cleaning solution supplying unit supplies the cleaning solution to the irradiation face, wherein the cleaning solution supplying unit further includes a second nozzle, disposed in the non-holding area, that moves to the position for facing the irradiation face and injects the cleaning solution to the irradiation face in accordance with rotation of the rotary body, and wherein the touch member moves to the touching position and is brought into touch with the irradiation face in accordance with the rotation of the rotary body after the second nozzle moves to the facing position and injects the cleaning solution to the irradiation face in accordance with rotation of the rotary body.

2. The ink injecting apparatus according to claim 1, further comprising a removal unit that is used for removing the ultraviolet-curable ink adhering to the touch member at a time when the ultraviolet-curable ink is removed by bringing the touch member into touch with the irradiation face.

3. The ink injecting apparatus according to claim 2, wherein the touch member moves from the touching position to a position for contacting the removal unit and is brought into contact with the removal unit, in accordance with rotation of the rotary body after being brought into touch with the irradiation face in the touching position, and wherein, when the touch member is brought into contact with the removal unit, the removal unit cleans the touch member by using a cleaning solution.

4. The ink injecting apparatus according to claim 3, wherein the cleaning solution is silicon oil.

5. The ink injecting apparatus according to claim 4, wherein the cleaning solution is silicon oil to which a polymerization inhibitor is added.

6. The ink injecting apparatus according to claim 1, further comprising a change mechanism that changes a protrusion amount of the touch member, wherein the rotary body is a rotary drum that rotates with the circumferential face facing a nozzle face in which the nozzle is formed and the irradiation face, wherein the touch member protrudes to the outer side of the rotary drum in the diameter direction, and wherein the change mechanism changes the protrusion amount such that the touch member is brought into touch with the irradiation face at a time when the touch member moves to the touching position in accordance with rotation of the rotary drum, and the touch member is not brought into touch with the nozzle face at a time when the touch member is located in the position for facing the nozzle face in accordance with rotation of the rotary drum.

7. An ink injecting apparatus comprising:

a nozzle that is used for injecting ultraviolet-curable ink to a medium;

an irradiation unit that includes an irradiation face for irradiating an ultraviolet ray to the ultraviolet-curable ink adhering to the medium;

a rotary body that has a holding area for holding the medium and a non-holding area on a circumferential face, rotates with the circumferential face facing the irradiation face, and includes a touch member that moves to a position for touching the irradiation face and is brought into touch with the irradiation face in the non-holding area in accordance with rotation of the rotary body for removing the ultraviolet-curable ink adhering to the irradiation face, wherein a length of the touch member in a longitudinal direction is longer than a length of the irradiation unit in a scanning direction; and a cleaning solution supplying unit that supplies a cleaning solution to the irradiation face for adhering the cleaning solution to the irradiation face, wherein the touch member moves to the position for touching the irradiation face and is brought into touch with the irradiation face in accordance with rotation of the rotary body after the cleaning solution supplying unit supplies the cleaning solution to the irradiation face, wherein the cleaning solution supplying unit further includes a protrusion part, disposed in the non-holding area, that moves to the position for contacting the irradiation face and is brought into contact with the irradiation face in a front end portion containing the cleaning solution in accordance with the rotation of the rotary body, and wherein the touch member moves to the touching position and is brought into touch with the irradiation face in accordance with rotation of the rotary body after the protrusion part moves to the position for contacting the irradiation face and is brought into contact with the irradiation face in the front end portion in accordance with rotation of the rotary body.

* * * * *